US011217177B2

(12) United States Patent
Kim et al.

(10) Patent No.: US 11,217,177 B2
(45) Date of Patent: Jan. 4, 2022

(54) EMISSION DRIVER AND DISPLAY DEVICE INCLUDING THE SAME

(71) Applicant: SAMSUNG DISPLAY CO., LTD., Yongin-si (KR)

(72) Inventors: Ki Wook Kim, Yongin-si (KR); Yang Wan Kim, Yongin-si (KR); Jong Won Park, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/000,784

(22) Filed: Aug. 24, 2020

(65) Prior Publication Data

US 2021/0183312 A1 Jun. 17, 2021

(30) Foreign Application Priority Data

Dec. 16, 2019 (KR) ..... 10-2019-0168093

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3266* (2013.01); *G09G 3/3275* (2013.01); *G09G 2300/0809* (2013.01); *G09G 2310/027* (2013.01); *G09G 2310/0291* (2013.01); *G09G 2310/08* (2013.01); *G09G 2320/0257* (2013.01)

(58) Field of Classification Search
CPC .. G09G 3/3258; G09G 3/3266; G09G 3/3275; G09G 2300/0809; G09G 2310/08; G09G 2310/027; G09G 2310/0291; G09G 2320/0257; G09G 2330/021; G09G 2330/00
See application file for complete search history.

(56) References Cited

U.S. PATENT DOCUMENTS 6,011,531 A 1/2000 Mei et al.
8,553,767 B2 10/2013 Kwon
(Continued)

FOREIGN PATENT DOCUMENTS

CN 109725448 5/2019
EP 0293048 11/1988
(Continued)

*Primary Examiner* — Michael J Eurice
(74) *Attorney, Agent, or Firm* — F. Chau & Associates, LLC

(57) ABSTRACT

Provided herein is a display device including a plurality of pixels, wherein each pixel of the plurality of pixels includes: a driving transistor including a first electrode, a second electrode, and a first gate electrode; a first emission transistor including a third electrode coupled to the first electrode of the driving transistor, a fourth electrode, and a second gate electrode; and a second emission transistor including a fifth electrode coupled to the second electrode of the driving transistor, a sixth electrode, and a third gate electrode, wherein both the second gate electrode and the third gate electrode are coupled to an emission line, and wherein the first emission transistor is turned-on but the second emission transistor is turned-off, based on an emission signal supplied from the emission line.

25 Claims, 14 Drawing Sheets

(51) Int. Cl.
*G09G 3/3266* (2016.01)
*G09G 3/3275* (2016.01)

(56) References Cited

U.S. PATENT DOCUMENTS

| | | | | |
|---|---|---|---|---|
| 9,543,026 | B2 | 1/2017 | Jang | |
| 10,964,264 | B1 * | 3/2021 | Kim | H01L 27/3276 |
| 2009/0146987 | A1 * | 6/2009 | Kim | G09G 3/3233 345/212 |
| 2014/0333214 | A1 * | 11/2014 | Okuno | G09G 3/3233 315/172 |
| 2015/0022514 | A1 * | 1/2015 | Lee | G09G 3/3233 345/212 |
| 2015/0049126 | A1 * | 2/2015 | Jung | G09G 3/3233 345/690 |
| 2016/0180818 | A1 * | 6/2016 | Kim | G09G 3/3233 345/213 |
| 2016/0293079 | A1 * | 10/2016 | Kim | G09G 3/3233 |
| 2019/0035322 | A1 | 1/2019 | Kim et al. | |
| 2019/0066604 | A1 * | 2/2019 | Kong | G09G 3/3266 |
| 2020/0302887 | A1 | 9/2020 | Chen et al. | |

FOREIGN PATENT DOCUMENTS

| | | |
|---|---|---|
| KR | 10-0893482 | 4/2009 |
| KR | 10-2016-0073928 | 6/2016 |
| KR | 10-2019-0012719 | 2/2019 |
| KR | 10-1975581 | 4/2019 |

* cited by examiner

EMISSION DRIVER AND DISPLAY DEVICE INCLUDING THE SAME

CROSS-REFERENCE TO RELATED APPLICATION

The present application claims priority under 35 U.S.C. § 119 to Korean patent application No. 10-2019-0168093 filed on Dec. 16, 2019, the entire disclosure of which is incorporated by reference herein in its entirety.

TECHNICAL FIELD

The present disclosure generally relates to display devices, and more particularly relates to an emission driver and a display device including the same for displaying images at multiple frequencies.

RELATED ART

Light-emitting display devices are largely classified into inorganic light-emitting display devices and organic light-emitting display devices, depending on the material of an emission layer. An organic light-emitting display device of active matrix type includes an organic light-emitting diode (hereinafter, referred to as an "OLED"), which emits light by itself, and may have relatively fast response time, high light-emission efficiency, high luminance, and a large viewing angle.

SUMMARY

Exemplary embodiments of the present disclosure are directed to a display device in which visibility of an after-image is minimized while the display device is driven at a plurality of frequencies.

Furthermore, exemplary embodiments of the present disclosure are directed to a display device including an emission driver that enables a driving transistor to be in an on-biased state using a supply voltage.

The present disclosure is not limited to the exemplary embodiments described herein, and other technical variations that are not mentioned may be readily understood by a person of ordinary skill in the art based on the following description.

An exemplary embodiment of the present disclosure includes a display device comprising: a plurality of pixels, wherein each pixel of the plurality of pixels includes: a driving transistor including a first electrode, a second electrode, and a first gate electrode; a first emission transistor including a third electrode coupled to the first electrode of the driving transistor, a fourth electrode, and a second gate electrode; and a second emission transistor including a fifth electrode coupled to the second electrode of the driving transistor, a sixth electrode, and a third gate electrode, wherein both the second gate electrode and the third gate electrode are coupled to an emission line, and wherein the first emission transistor is turned-on but the second emission transistor is turned-off, based on an emission signal supplied from the emission line.

The display device may further include an emission driver configured to supply the emission signal to both the second gate electrode and the third gate electrode through the emission line.

The emission driver may supply to the pixel the emission signal having a first level, a second level, or a third level between the first level and the second level through the emission line.

When the emission signal of the third level is supplied to the pixel, the first emission transistor may be turned-on, but the second emission transistor may be turned-off.

When the emission signal of the first level is supplied to the pixel, the first emission transistor and the second emission transistor may be turned-off, and when the emission signal of the second level is supplied to the pixel, the first emission transistor and the second emission transistor may be turned-on.

The driving transistor, the first emission transistor, and the second emission transistor may be P-type metal-oxide-semiconductor (PMOS) transistors.

When the emission signal of the third level is supplied to the pixel, the driving transistor may be set to an on-biased state.

A threshold voltage of the second emission transistor is greater than a threshold voltage of the first emission transistor.

A voltage range of the third level may vary from about 7.5V to about 8.5V.

Each pixel of the plurality of pixels may further include a light-emitting diode, and the sixth electrode may be coupled to the anode of the light-emitting diode.

The fourth electrode may be coupled to a first power line through which a first power voltage signal is supplied, and the cathode of the light-emitting diode may be coupled to a second power line through which a second power voltage signal having a lower level than the first power voltage signal.

An exemplary embodiment of the present disclosure includes an emission driver comprising: a plurality of stage circuits, each of the stage circuits including: a carry controller which generates a first output signal having a first level or a second level based on a first control signal and a second control signal; and an output buffer which is coupled to a first control line and a second control line, and generates a second output signal having one of the first level, the second level, and a third level between the first level and the second level based on the first control signal supplied from the first control line and the second control signal supplied from the second control line.

The output buffer may be coupled to an intermediate voltage signal line through which one of a voltage signal of the first level and a voltage signal of the third level is supplied.

In a first period of a frame period, the output buffer may generate the second output signal having the first level based on the first control signal, and in a second period of the frame period, the output buffer may generate the second output signal having the third level based on the first control signal.

The stage circuits may include a first stage circuit and a second stage circuit, the second stage circuit may be connected to the first stage circuit, and the first output signal of the first stage circuit may be supplied to the carry controller of the second stage circuit.

An exemplary embodiment of the present disclosure includes a display device comprising: a display including a plurality of pixel rows, each of which is defined by a plurality of pixels coupled to a same emission line; a scan driver configured to supply a scan signal to each of the pixels; a data driver configured to supply a data signal to each of the pixels; and an emission driver configured to supply an emission signal to each of the pixel rows through the emission line, wherein the emission signal has a first level, a second level, or a third level between the first level and the second level.

The emission driver may include a pair of emission drivers disposed on opposite sides of the display, respectively.

The display may include the plurality of pixel rows may include first to k-th pixel rows and (k+1)-th to n-th pixel rows, and the emission signal of the third level may be supplied to at least some of the first to k-th pixel rows within a period in which the emission signal of the first level is supplied to at least some of the (k+1)-th to n-th pixel rows.

The first level may be higher than the second level.

The first to k-th pixel rows may be coupled to a first intermediate voltage line through which a voltage of the third level is supplied, and the (k+1)-th to n-th pixel rows may be coupled to a second intermediate voltage line through which a voltage of the third level is supplied, where k and n are natural numbers and k is greater than 1 and less than n.

The first intermediate voltage line and the second intermediate voltage line may be insulated from each other and may cross over each other.

The k may be substantially half of n.

A frame period may include: a data programming period in which the data signal is written and each of the pixels emits light; and a holding period in which the emission signal of the third level is supplied to each of the pixels and each of the pixels emits light.

Each of the pixels may be driven at a first frequency and a second frequency, which is lower than the first frequency.

When driven at the second frequency, the frame period may further include a porch period in which respective pixels arranged in parallel in a horizontal direction are synchronized, for each frame.

Other details of the exemplary embodiments are included in the detailed description and the drawings.

DETAILED DESCRIPTION

Figure 1:
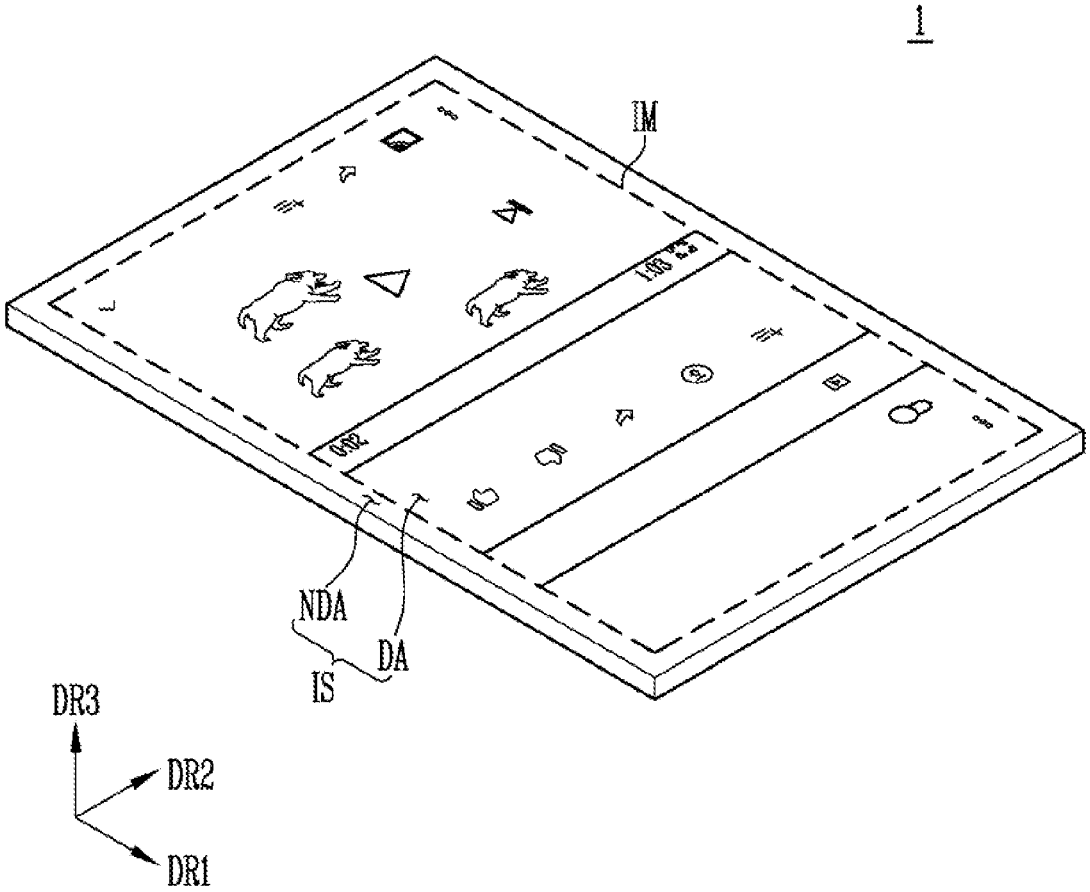
FIG. 1 is a perspective view of a display device according to an embodiment of the present disclosure.

Understanding of the present disclosure, including exemplary devices and methods of operation, will be apparent from the following exemplary embodiments to be described in more detail with reference to the accompanying drawings. However, the present disclosure is not limited to the following exemplary embodiments, and may be implemented in various forms. Accordingly, the exemplary embodiments are provided only to describe the present disclosure and to let those skilled in the art know the category of the present disclosure, while the present invention is to be defined based on the claims.

When it is expressed that a first element or layer is formed on a second element or layer, the first element or layer may be not only directly on the second element or layer but a third element or layer may intervene therebetween. The same reference numerals or the same reference designators denote the same elements throughout the specification.

Terms such as "first" and "second" may be used to describe various components, but they should not limit the various components. Those terms are only used for the purpose of differentiating a component from other components. For example, a first component may be referred to as a second component, and a second component may be referred to as a first component and so forth without departing from the spirit and scope of the present disclosure. Furthermore, a singular form may include a plural from as long as it is not specifically mentioned in a sentence.

A driving circuit of a flat panel display device includes a data driving circuit configured to supply a data signal to data lines, a scan driving circuit configured to supply a scan signal to scan lines or gate lines, and an emission driving circuit configured to supply an emission signal, an emission control signal, or the like. The emission driving circuit may be formed directly on the same substrate on which circuit elements of an active area configuring a screen are formed. The circuit elements of the active area configure a pixel circuit formed in each of the pixels that are defined in the form of a matrix by the data lines and the emission driving circuits of a pixel array. Each of the circuit elements of the active area and the emission driving circuits includes a plurality of transistors.

A method of driving the display device at a plurality of frequencies may be employed, which may reduce power consumed by the display device. When the display device is driven at some frequencies, an afterimage may be visible. In a preferred embodiment, the display device may include a driving transistor within a pixel circuit configured to an on-biased state before light emission, which may reduce the visibility of such an afterimage.

Hereinafter, exemplary embodiments of the present disclosure will be described in detail with reference to the accompanying drawings. Identical or similar reference numerals may be used to designate the same or like elements in the drawings.

FIG. 1 illustrates a display device according to an embodiment of the present disclosure. The display device of FIG. 1 may be used not only in a large electronic device, such as a television, a monitor, or the like, but also in a small or medium-sized electronic device, such as a mobile phone, a tablet PC, a vehicle navigation system, a game device, a smartwatch, or the like.

Referring to FIG. 1, the display device 1 according to an embodiment of the present disclosure includes a display surface IS configured to display an image. The display surface IS on which an image IM is displayed is parallel to a surface defined by a first direction DR1 and a second direction DR2. The direction perpendicular to the display surface IS, that is, the thickness direction of the display device 1, is indicated by a third direction DR3. Thus, the directions DR1, DR2 and DR3 may be mutually orthogonal.

In the present embodiment, the height direction of the display device 1 is defined as the first direction DR1 and a direction intersecting the first direction DR1 is defined as the second direction DR2 for the convenience of description. That is, the second direction DR2 may indicate the width direction of the display device 1. The thickness direction of the display device 1, which intersects each of the first direction DR1 and the second direction DR2, is defined as the third direction DR3. However, embodiments are not limited to the above-mentioned directions, and it shall be understood that the first direction DR1, the second direction DR2, and the third direction DR3 are the relative directions that intersect each other.

In an embodiment, the display surface IS of the display device 1 may include a plurality of areas. The display surface IS of the display device 1 may include a display area DA, in which an image IM is displayed, and a non-display area NDA, which is adjacent to the display area DA.

The display area DA is defined as an area in which an image is displayed. Also, the display area DA may be used as a detection member for detecting an external environment. That is, the display area DA may be used as an area for displaying an image and recognizing the fingerprint of a user or a touch by the user, for example. The display area DA may have a flat shape in an embodiment, but without limitation thereto, so at least part of the display area DA may have curvature.

The non-display area NDA may be an area in which no image is displayed. The non-display area NDA may have a shape that surrounds the display area DA. However, without limitation thereto, the shape of the display area DA and the shape of the non-display area NDA may be changed relative to each other.

In operation, FIG. 1 illustrates a video player application running on the display device 1 as an example of the image IM. In an embodiment, the display device 1 may be driven at a plurality of frequencies. For example, the display device 1 may be driven at a first frequency, which is a relatively high frequency, when content on the display area DA of the display device 1 is scrolled by a user or when a moving image is displayed. The display device 1 may be driven at a second frequency, which is a relatively low frequency, when a still image is displayed in the display area DA of the display device 1. When the display device 1 is driven at a variable frequency, such as by switching to the first or second frequency, power consumption may be reduced compared to when driven only at the first frequency.

In an embodiment, the display device 1 may be driven in such a way that different frequencies are used for respective areas in the display area DA. For example, a portion of the display area DA in which a moving image is displayed may be driven at the first frequency, which is a relatively high frequency, and another portion of the display area DA in which a still image is displayed may be driven at the second frequency, which is a relatively low frequency. When the display device 1 is configured such that the display area DA thereof is divided into a plurality of areas to be driven at different frequencies, power consumption may be reduced compared to when the entire display area DA is driven only at the first frequency.

Figure 2:
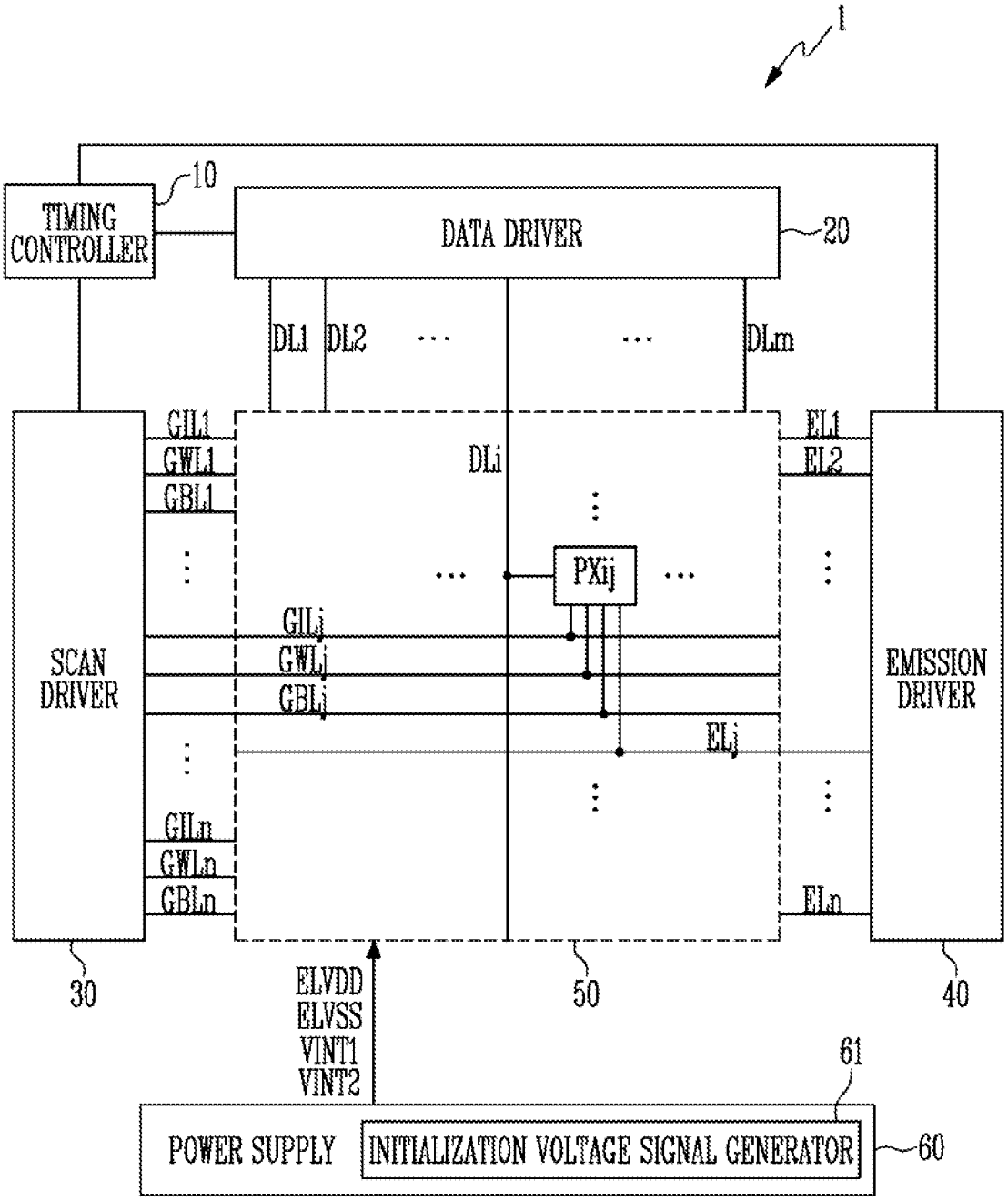
FIG. 2 is a block diagram schematically illustrating a display device according to an embodiment of the present disclosure.
Figure 3:
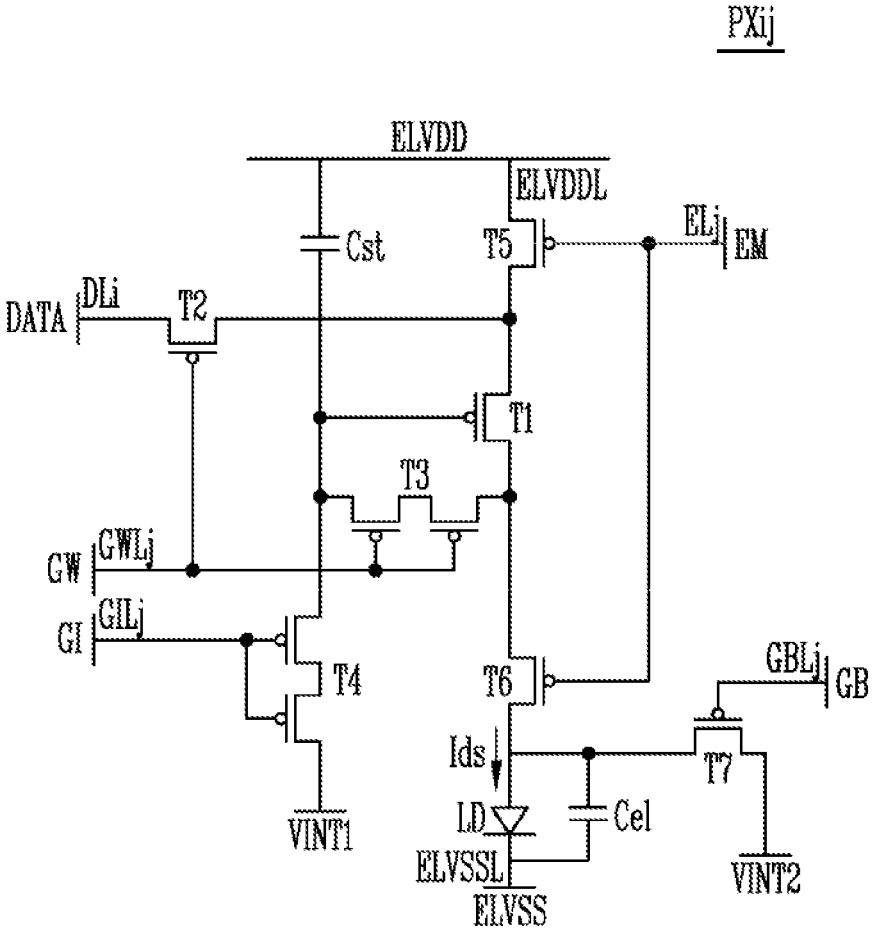
FIG. 3 is an equivalent circuit diagram of a pixel in the display device of FIG. 2.

FIG. 2 illustrates a display device according to an embodiment of the present disclosure. FIG. 3 illustrates a pixel in the display device of FIG. 2.

Referring to FIG. 2, the display device 1 includes a timing controller 10, a data driver 20, a scan driver 30, an emission driver 40, a display 50, and a power supply 60. The timing controller 10 may generate signals required for the display device 1 by receiving an external input signal for an image frame from an external processor. For example, the timing controller 10 may supply grayscale values and control signals to the data driver 20. Also, the timing controller 10 may supply a clock signal, a scan start signal, and the like to the scan driver 30. Also, the timing controller 10 may supply a clock signal, an emission stop signal, and the like to the emission driver 40.

The data driver 20 may generate data voltages to be supplied to data lines DL1, DL2, . . . , DLm using the grayscale values and the control signals received from the timing controller 10. For example, the data driver 20 may sample the grayscale values using a clock signal and apply the data voltages corresponding to the grayscale values to the data lines DL1, DL2, . . . , DLm in units of pixel rows (e.g., pixels coupled to the same scan line). Here, m may be a natural number.

The scan driver 30 may generate scan signals to be supplied to scan lines GIL1, GWL1, GBL1, . . . , GILn, GWLn, and GBLn by receiving a clock signal, a scan start signal, and the like from the timing controller 10. Here, n may be a natural number.

Although not illustrated, the scan driver 30 may include a plurality of sub-scan drivers. For example, the first sub-scan driver may supply scan signals for the first scan lines GIL1, . . . , GILn, the second sub-scan driver may supply scan signals for the second scan lines GWL1, . . . , GWLn, and the third sub-scan driver may supply scan signals for the third scan lines GBL1, . . . , GBLn. Each of the sub-scan drivers may include a plurality of scan stage circuits that are coupled in the form of a shift register. For example, scan signals may be generated in a manner in which a scan start signal having a pulse of a turned-on level is supplied to a scan start line and the pulse is sequentially transmitted to the next scan stage.

The emission driver 40 may generate emission signals to be supplied to emission lines EL1, EL2, . . . , ELn by receiving a clock signal, an emission stop signal, and the like from the timing controller 10. For example, the emission driver 40 may sequentially supply emission signals having a pulse of a turned-off level, such as VGH, to the emission lines EL1, EL2, . . . , ELn. For example, the emission driver 40 may be configured in the form of a shift register, and may generate emission signals by sequentially transmitting an emission stop signal having a pulse of a turned-off level to the next emission stage circuit (hereinafter, referred to as a stage circuit) under the control of the clock signal.

The display 50 includes pixels PXij. For example, a pixel PXij may be coupled to a data line DLi, a plurality of scan lines GILj, GWLj and GBLj, and an emission line ELj corresponding thereto. However, the number of data lines DLi, scan lines GILj, GWLj and GBLj, and emission lines ELj corresponding to the pixel PXij is not limited to those of the illustrated example.

The plurality of pixels PXij may define an emission area that emits a plurality of colors of light. For example, the plurality of pixels PXij may define an emission area that emits red light, green light, and blue light. For example, the pixel PXij includes a plurality of transistors and at least one capacitor.

The display 50 may define a display area (DA in FIG. 1) including the emission area that emits a plurality of colors defined by the pixels PXij.

In an embodiment, the pixels PXij may be arranged in the form of a matrix. For example, the pixels PXij arranged in a row direction, among the pixels PXij, may be coupled to the same first scan lines GIL1, . . . , GILn, the same second scan lines GWL1, . . . , GWLn, the same third scan lines GBL1, . . . , GBLn, and the same emission lines EL1, EL2, . . . , ELn, respectively. The row direction may be the above-described second direction DR2. The pixels arranged in a row direction and coupled to the same first scan lines GIL1, . . . , GILn, the same second scan lines GWL1, . . . , GWLn, the same third scan lines GBL1, . . . , GBLn, and the same emission lines EL1, EL2, . . . , ELn, respectively, may define a pixel row.

The power supply 60 may receive an external input voltage signal and convert the same, thereby supplying a supply voltage signal to an output terminal. For example, the power supply 60 generates a high-supply voltage signal ELVDD and a low-supply voltage signal ELVSS based on the external input voltage. In the present embodiment, the high-supply voltage signal ELVDD and the low-supply voltage signal ELVSS may be power having a relative voltage level. The power supply 60 may supply each pixel PXij with a first initialization voltage signal VINT1 configured to initialize the gate electrode of a driving transistor (T1 in FIG. 3) and a second initialization voltage signal VINT2 configured to initialize the anode of a light-emitting diode (LD in FIG. 3).

The power supply 60 may receive an external input voltage signal from a battery or the like, and may generate a supply voltage signal that is higher than the external input voltage signal by boosting the external input voltage. For example, the power supply 60 may be configured as a power management integrated circuit (PMIC). For example, the power supply 60 may be configured as an external DC/DC PMIC.

The power supply 60 may include an initialization voltage signal generator 61. The initialization voltage signal generator 61 may control the supply periods of the initialization voltages VINT1 and VINT2, which are supplied to each pixel PXij. That is, the initialization voltage signal generator 61 may control the supply periods of the initialization voltages VINT1 and VINT2 supplied to each pixel PXij separately.

Referring to FIG. 3, the pixel PXij according to an embodiment of the present disclosure includes a plurality of transistors T1, T2, T3, T4, T5, T6 and T7, a storage capacitor Cst and a light-emitting diode LD.

The first transistor T1 may be configured such that the first electrode thereof is coupled to the first electrode of the second transistor T2 and the second electrode of the fifth transistor T5, the second electrode thereof is coupled to the first electrode of the third transistor T3 and the first electrode of the sixth transistor T6, and the gate electrode thereof is coupled to the second electrode of the third transistor T3. The first transistor T1 may be referred to as a driving transistor. In the present embodiment, any one of the first and second electrodes of each transistor is a source electrode and the other one is a drain electrode.

The second transistor T2 may be configured such that the first electrode thereof is coupled to the first electrode of the first transistor T1, the second electrode thereof is coupled to a data line DLi, and the gate electrode thereof is coupled to a second scan line GWLj. The second transistor T2 may be referred to as a scan transistor.

The third transistors T3 may take a form in which a plurality of transistors are coupled in series. The third transistors T3 may be configured such that the first electrode of the transistor T3 on one side is coupled to the second electrode of the first transistor T1, the second electrode of the transistor T3 on the other side is coupled to the gate electrode of the first transistor T1, and the gate electrodes of the third transistors T3 are coupled to the second scan line GWLj. The third transistors T3 may be referred to as a diode-coupled transistor.

The fourth transistors T4 may take a form in which a plurality of transistors are coupled in series. The fourth transistors T4 may be configured such that the first electrode of the transistor T4 on one side is coupled to the second electrode of the storage capacitor Cst, the second electrode of the transistor T4 on the other side is coupled to a first initialization line through which a first initialization voltage signal VINT1 is supplied, and the gate electrodes of the fourth transistors T4 are coupled to a first scan line GILj. The fourth transistors T4 may be referred to as a gate initialization transistor. The third transistors T3 and the fourth transistors T4 are configured such that a plurality of transistors are coupled in series, whereby current leakage may be minimized.

The fifth transistor T5 may be configured such that the first electrode thereof is coupled to a high-power line ELVDDL, the second electrode thereof is coupled to the first electrode of the first transistor T1, and the gate electrode thereof is coupled to an emission line ELj. The fifth transistor T5 may be referred to as a first emission transistor.

The sixth transistor T6 may be configured such that the first electrode thereof is coupled to the second electrode of the first transistor T1, the second electrode thereof is coupled to the anode of the light-emitting diode LD, and the gate electrode thereof is coupled to the emission line ELj. The sixth transistor T6 may be referred to as a second emission transistor.

In an embodiment, the threshold voltages of the fifth transistor T5 and the sixth transistor T6 may be slightly different. For example, if both are P-type as depicted in FIG. 3, the threshold voltage of the sixth transistor T6 may be a slightly lower negative voltage than that of the fifth transistor T5. That is, when the gate voltage signal of each of the fifth transistor T5 and the sixth transistor T6 has a specific voltage level, the fifth transistor T5 may be placed in a turned-on state, but the sixth transistor T6 may be placed in a turned-off state. The specific voltage level may range from about 7.5 V to 8.5 V at the gate, where the gate-source voltage signal Vgs, to overcome each respective threshold voltage Vth, is this specific voltage level at the gate minus the voltage level at the source (e.g., ELVDD), but is not limited to this voltage level range.

In an embodiment, the gate electrode of the fifth transistor T5 and the gate electrode of the sixth transistor T6 may be coupled to the same emission line ELj. That is, the gate electrode of the fifth transistor T5 and the gate electrode of the sixth transistor T6 may be electrically coupled to each other.

The seventh transistor T7 may be configured such that the first electrode thereof is coupled to the anode of the light-emitting diode LD, the second electrode thereof is coupled to a second initialization line through which a second initialization voltage signal VINT2 is supplied, and the gate electrode thereof is coupled to a third scan line GBLj. The seventh transistor T7 may be referred to as an anode initialization transistor.

Because the gate electrode of the first transistor T1 is electrically coupled to the first initialization line to which VINT1 is applied and the anode of the light-emitting diode LD is electrically coupled to the second initialization line to which VINT2 is applied, the initialization voltage signal of the gate electrode of the first transistor T1 may be set to a different voltage level independently from the initialization voltage signal of the anode of the light-emitting diode LD. Accordingly, electrical stress or degradation of an initialization signal, such as but not limited to electric overstress (EOS), caused due to an initialization voltage signal being applied to both the gate electrode of the first transistor T1 and to the anode of the light-emitting diode LD, may be reduced or avoided.

The storage capacitor Cst may be configured such that the first electrode thereof is coupled to the high-power line ELVDDL and the second electrode thereof is coupled to the gate electrode of the first transistor T1.

The light-emitting diode LD may be configured such that the anode thereof is coupled to the second electrode of the sixth transistor T6 and the cathode thereof is coupled to a low-power line ELVSSL. The voltage signal ELVSS applied to the low-power line ELVSSL may be set lower than the voltage signal ELVDD applied to the high-power line ELVDDL. The light-emitting diode LD may be an organic light-emitting diode, an inorganic light-emitting diode, a quantum dot light-emitting diode, or the like.

The light-emitting diode LD may have its own capacitance Cel. For example, the cathode of the light-emitting diode LD may form capacitance Cel through a relationship with the anode thereof, the second electrode of the sixth transistor T6, and the first electrode of the seventh transistor T7.

The light emission amount of the light-emitting diode LD may be determined depending on the current level of a driving current Ids supplied from the high-power line ELVDDL. The driving current Ids may be the drain-source current Ids of the first transistor T1. The current level of the driving current Ids may be directly affected by the transistors coupled between the high-power line ELVDDL and the low-power line ELVSSL. For example, in the present embodiment, the transistors coupled between the high-power line ELVDDL and the low-power line ELVSSL are the first transistor T1, the fifth transistor T5, and the sixth transistor T6. In the present embodiment, the driving current Ids is substantially the same as the drain-source current Ids of the first transistor T1, and thus the same reference numeral is used therefor.

In an embodiment, the transistors T1 to T7 may be P-type (PMOS) transistors. The channels of the transistors T1 to T7 may be formed of polysilicon. The polysilicon transistors may be low-temperature polysilicon (LTPS) transistors. The polysilicon transistors may have high electron mobility and thus a fast driving characteristic.

In another embodiment, the transistors T1 to T7 may be N-type (NMOS) transistors. Here, the channels of the transistors T1 to T7 may be formed of oxide semiconductors. A low-temperature process may be performed on an oxide semiconductor transistor, and the oxide semiconductor transistor may have lower charge mobility than a polysilicon transistor. Accordingly, the amount of leakage current generated in a turned-off state of oxide semiconductor transistors may be smaller than that of polysilicon transistors.

In yet another embodiment, some of the transistors (e.g., T1, T2, T5, T6 and T7) may be P-type transistors. Here, the other transistors (e.g., T3 and T4) may be N-type transistors.

While a data signal is being suppled because the second transistor T2 is turned on, the third transistor T3 is also turned on, whereby the gate electrode of the first transistor T1 and the second electrode thereof are electrically coupled to each other. Accordingly, the gate electrode and the second electrode may have the same electric potential. When the voltage signal difference (e.g., Vgs) between the gate and source (e.g., first electrode for P-type of FIG. 3) of the first transistor T1 is higher than the threshold voltage, the first transistor T1 forms a current path until the voltage difference between the gate electrode and the first electrode thereof is reduced to or below the threshold voltage of the first transistor T1, whereby the voltage potential of the gate electrode and the second electrode is charged. That is, when a data signal is supplied to the first electrode of the first transistor T1, the voltage of the gate electrode and the second electrode of the first transistor T1 rises to the differential voltage between the data signal and the threshold voltage. Accordingly, the first transistor T1 may be diode-coupled, and the threshold voltage may be compensated for.

Figure 4:
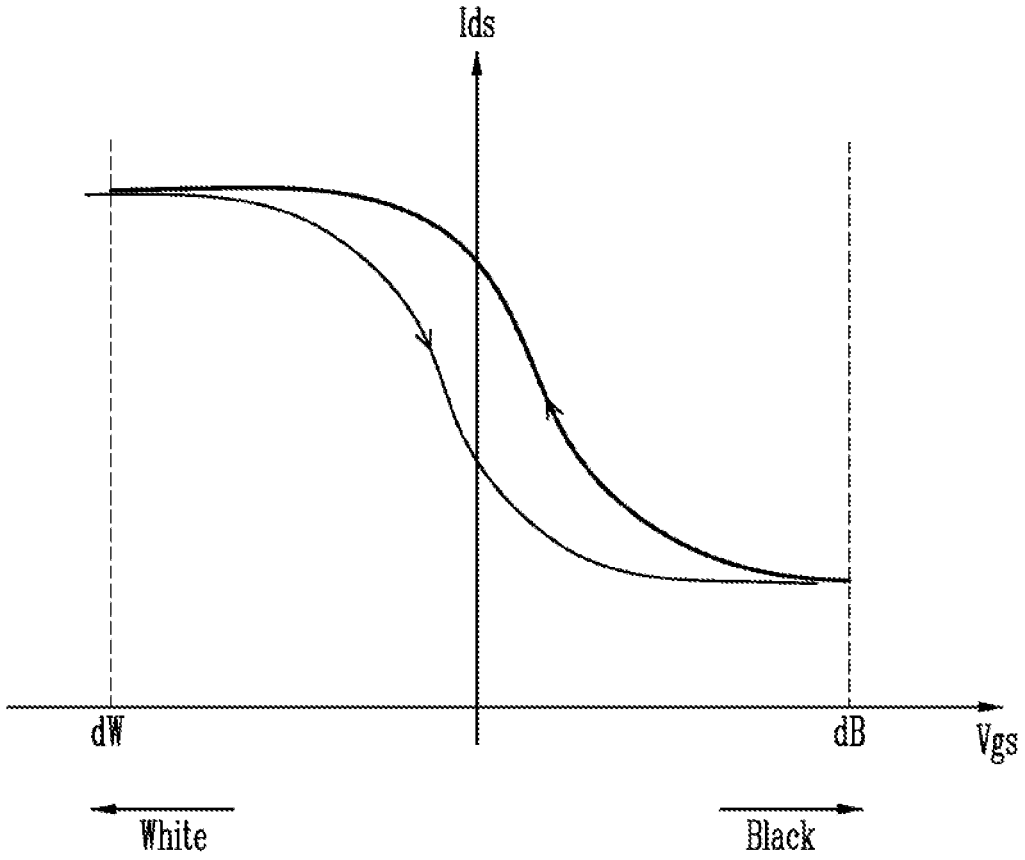
FIG. 4 is a graph illustrating the drain-source current of a driving transistor depending on the voltage signal difference between the gate and source of the driving transistor in a gate on-biased state and a gate off-biased state in a display device according to an embodiment of the present disclosure.

FIG. 4 illustrates the drain-source current of a driving transistor T1 in a display device according to an embodiment of the present disclosure. As shown, the drain-source or driving current achieved depends on the voltage difference between the gate and source of the driving transistor T1, which may differ for at least intermediate grayscale values based on whether the transistor begins in a gate on-biased state per the curve with right-downward-pointing arrow, or in a gate off-biased state per the curve with left-upward-pointing arrow.

The gate on-biased state (hereinafter, referred to as an on-biased state) means the state in which a peak white grayscale voltage signal dW is applied to the gate electrode of the first transistor T1, whereby the drain-source current Ids of the first transistor T1 corresponds to a full-white grayscale. For example, the drain-source current Ids corresponding to the full-white grayscale may be the current having the highest level.

The gate off-biased state (hereinafter, referred to as an off-biased state) means the state in which a peak black grayscale voltage dB is applied to the gate electrode of the driving transistor, whereby the drain-source current Ids of the first transistor T1 corresponds to a full-black grayscale. For example, the drain-source current Ids corresponding to the full-black grayscale may be the current having the lowest level.

The peak white grayscale voltage dW means the voltage applied to the gate electrode of the first transistor T1 in order to enable the light-emitting diode to emit light with the peak white grayscale, and the peak black grayscale voltage dB means the voltage applied to the gate electrode of the first transistor T1 in order to enable the light-emitting diode to emit light with the peak black grayscale. For example, when a grayscale value is represented as an 8-bit digital value, the peak black grayscale may correspond to the minimum value "0", and the peak white grayscale may correspond to the maximum value "255".

However, referring to FIG. 4, there is a difference in sweep curves of the on-biased state and the off-biased state in the P-type first transistor. This causes a different drain-source current Ids of the first transistor T1 for the same grayscale, depending on whether the beginning state is the on-biased state or the off-biased state.

That is, particularly when an intermediate grayscale value is expressed, the difference of sweep curves in the on-biased state and the off-biased state of the drain-source current characteristic of a driving transistor, based on the gate-source voltage difference of the driving transistor, is called a hysteresis phenomenon, and an afterimage may result therefrom.

Also, the difference in the drain-source current Ids might not fully stabilize the driving characteristic of the light-emitting diode, which is driven based on the driving current Ids, when, for example, a P-type transistor is used as the driving thin-film transistor of an organic light-emitting display device, whereby a luminance difference may result.

Particularly, when the display device 1 driven at a first frequency, which is a relatively high frequency, changes the driving frequency thereof to a second frequency, which is a relatively low frequency, so as to be driven at the second frequency, an afterimage caused due to a hysteresis phenomenon may be visible. Accordingly, in order to minimize visibility of an afterimage caused due to the hysteresis phenomenon when the display device 1 is driven at the second frequency, the driving transistor may be set to an on-biased state before a light emission period is started.

In the present embodiment, the driving transistor may be set to an on-biased state using the high-supply voltage signal ELVDD. That is, the high-supply voltage signal ELVDD is applied to the first electrode of the first transistor T1 by turning on the fifth transistor T5, whereby the first transistor T1 may be set to the on-biased state. At this time, the sixth transistor T6 maintains a turned-off state. Here, turning on the fifth transistor T5 while maintaining the turned-off state of the sixth transistor T6 may be achieved by controlling the emission driver 40. Hereinafter, the emission driver 40 will be described in greater detail.

Figure 5:
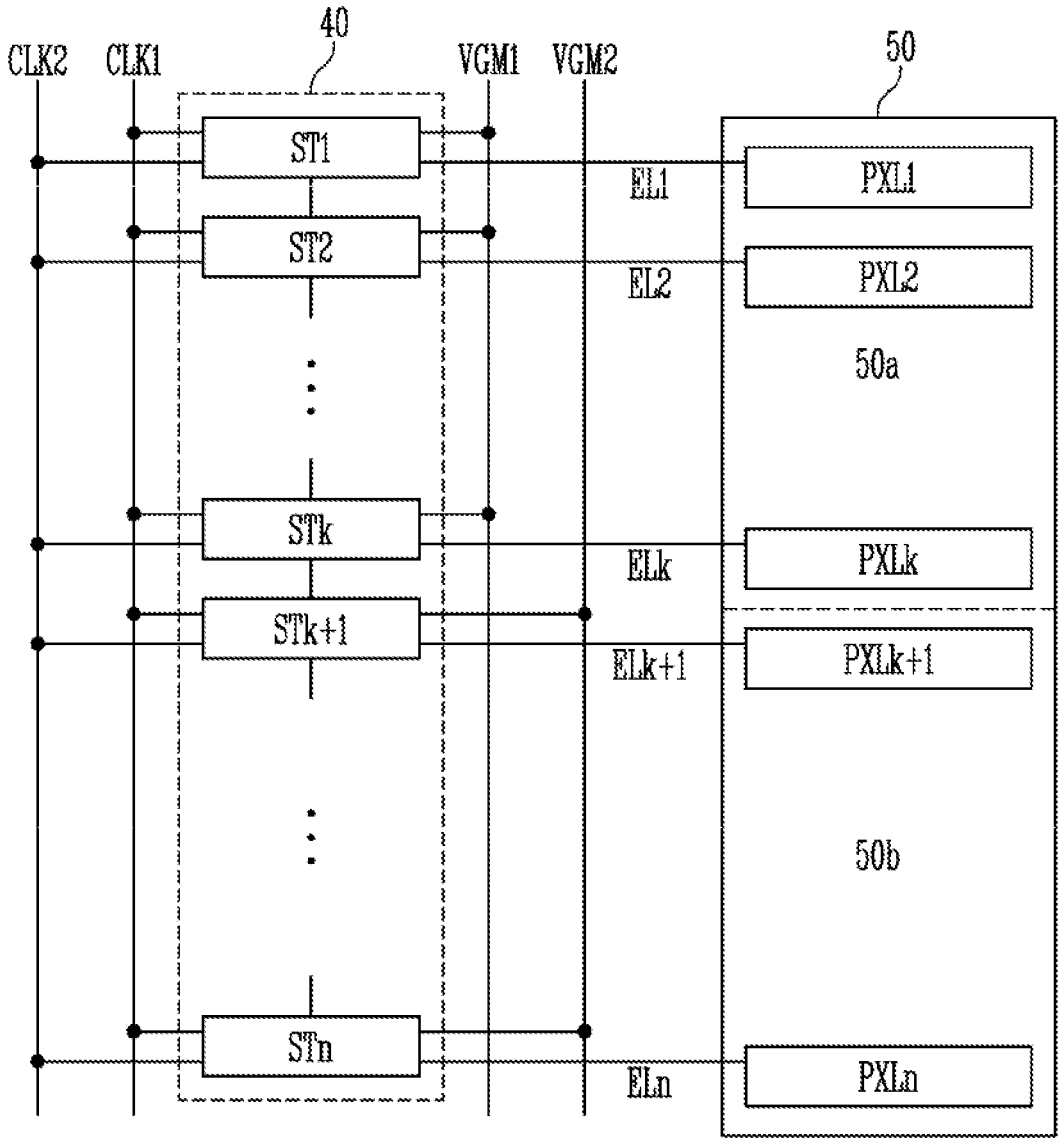
FIG. 5 is a block diagram illustrating the relationship between an emission driver and a display according to an embodiment of the present disclosure.

FIG. 5 illustrates the relationship between an emission driver and a display according to an embodiment of the present disclosure. Referring to FIG. 5, the emission driver 40 may include a plurality of stage circuits ST1 to STk and STk+1 to STn. Here, k may be a natural number that is greater than 1 and less than n. The plurality of stage circuits ST1 to STn may correspond to the pixel rows PXL1 to PXLn of the display 50.

Each of the stage circuits ST1 to STk and STk+1 to STn may be coupled to one end of a corresponding one of the emission lines EL1 to ELk and ELk+1 to ELn, and may supply an emission signal to all of the pixels in each of the pixel rows PXL1 to PXLn corresponding to the respective emission lines EL1 to ELk and ELk+1 to ELn.

The stage circuits ST1 to STk and STk+1 to STn may output a first output signal corresponding to a first voltage signal (VGH in FIG. 7) or a second voltage signal (VGL in FIG. 7) in response to clock signals CLK1 and CLK2 supplied from the timing controller 10.

The stage circuits ST1 to STk and STk+1 to STn may output the first output signal and a second output signal, which corresponds to a first intermediate voltage signal VGM1 or a second intermediate voltage signal VGM2, in response to a first control signal and a second control signal in each of the stage circuits ST1 to STk and STk+1 to STn.

The first intermediate voltage signal VGM1 may be supplied to the first to k-th stage circuits ST1 to STk corresponding to the first to k-th pixel rows PXL1 to PXLk, among the stage circuits ST1 to STk and STk+1 to STn. The second intermediate voltage signal VGM2 may be supplied to the (k+1)-th to n-th stage circuits STk+1 to STn corresponding to the (k+1)-th to n-th pixel rows PXLk+1 to PXLn, among the stage circuits ST1 to STk and STk+1 to STn.

In the display 50, a first pixel group 50*a*, including the first to k-th pixel rows PXL1 to PXLk, and a second pixel group 50*b*, including the (k+1)-th to n-th pixel rows PXLk+1 to PXLn, may be defined. That is, the first pixel group 50*a* and the second pixel group 50*b* may be differentiated from each other in such a way that the first pixel group 50*a* is supplied with the first intermediate voltage signal VGM1 from the emission driver 40 through the first to k-th emission lines EL1 to ELk and the second pixel group 50*b* is supplied with the second intermediate voltage signal VGM2 as the second output signal from the emission driver 40 through the (k+1)-th to n-th emission lines ELk+1 to ELn.

In an embodiment, a first intermediate voltage signal line, through which the first intermediate voltage signal VGM1 is supplied, and a second intermediate voltage signal line, through which the second intermediate voltage signal VGM2 is supplied, may be insulated from each other and cross over each other in an area adjacent to the (k+1)-th to n-th stage circuits STk+1 to STn. In an area adjacent to the first to k-th stage circuits ST1 to STk, the first intermediate voltage signal line and the second intermediate voltage signal line need not cross over each other, but they are not limited thereto.

In an embodiment, k and n may have a relationship of k=[n/2]. Here, '[x]' is the Gauss' notation that indicates the largest integer that is not greater than x. However, in some embodiments, when n is an odd number, the relationship may be k=[n/2]+1.

Figure 6:
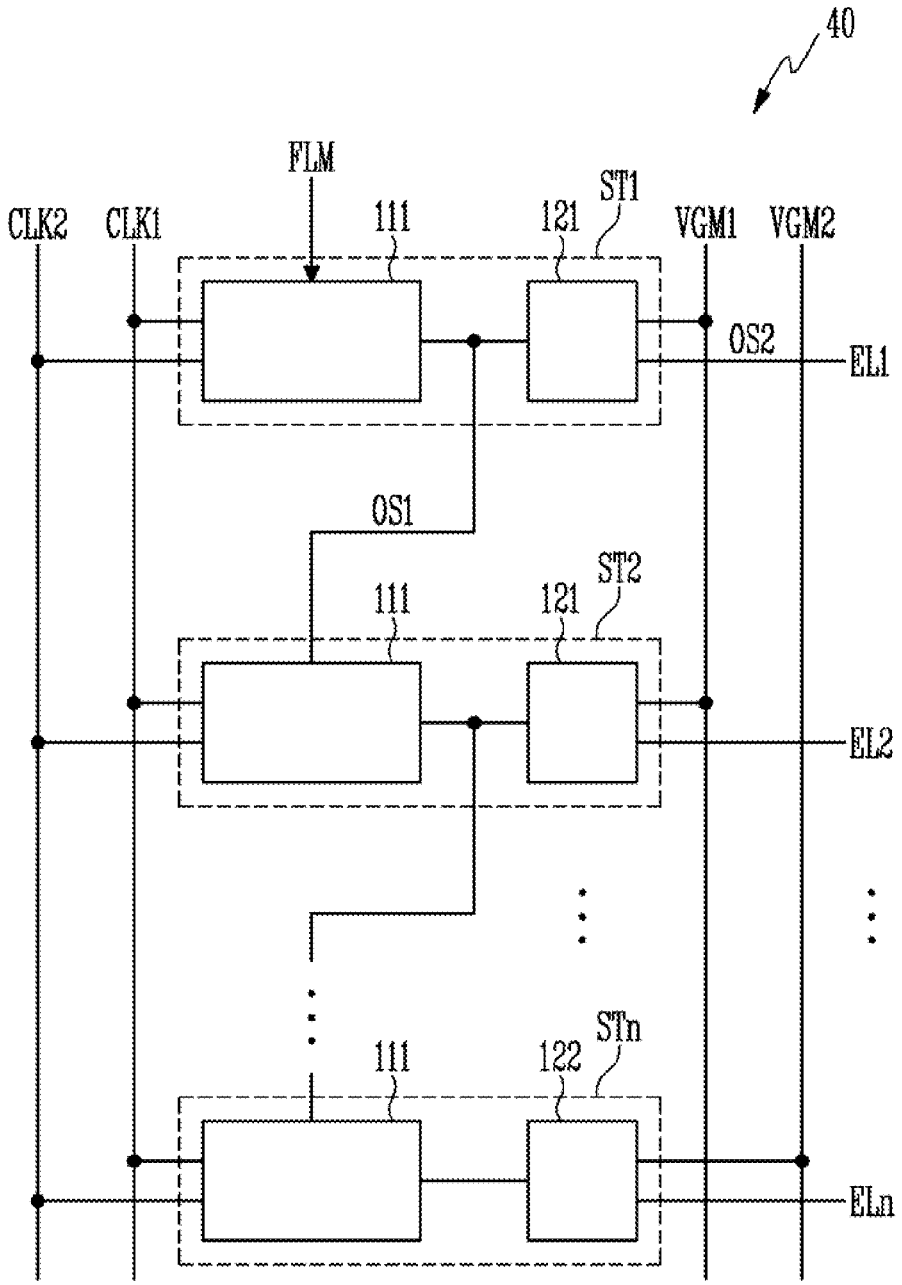
FIG. 6 is a block diagram more specifically illustrating an emission driver according to an embodiment of the present disclosure.
Figure 7:
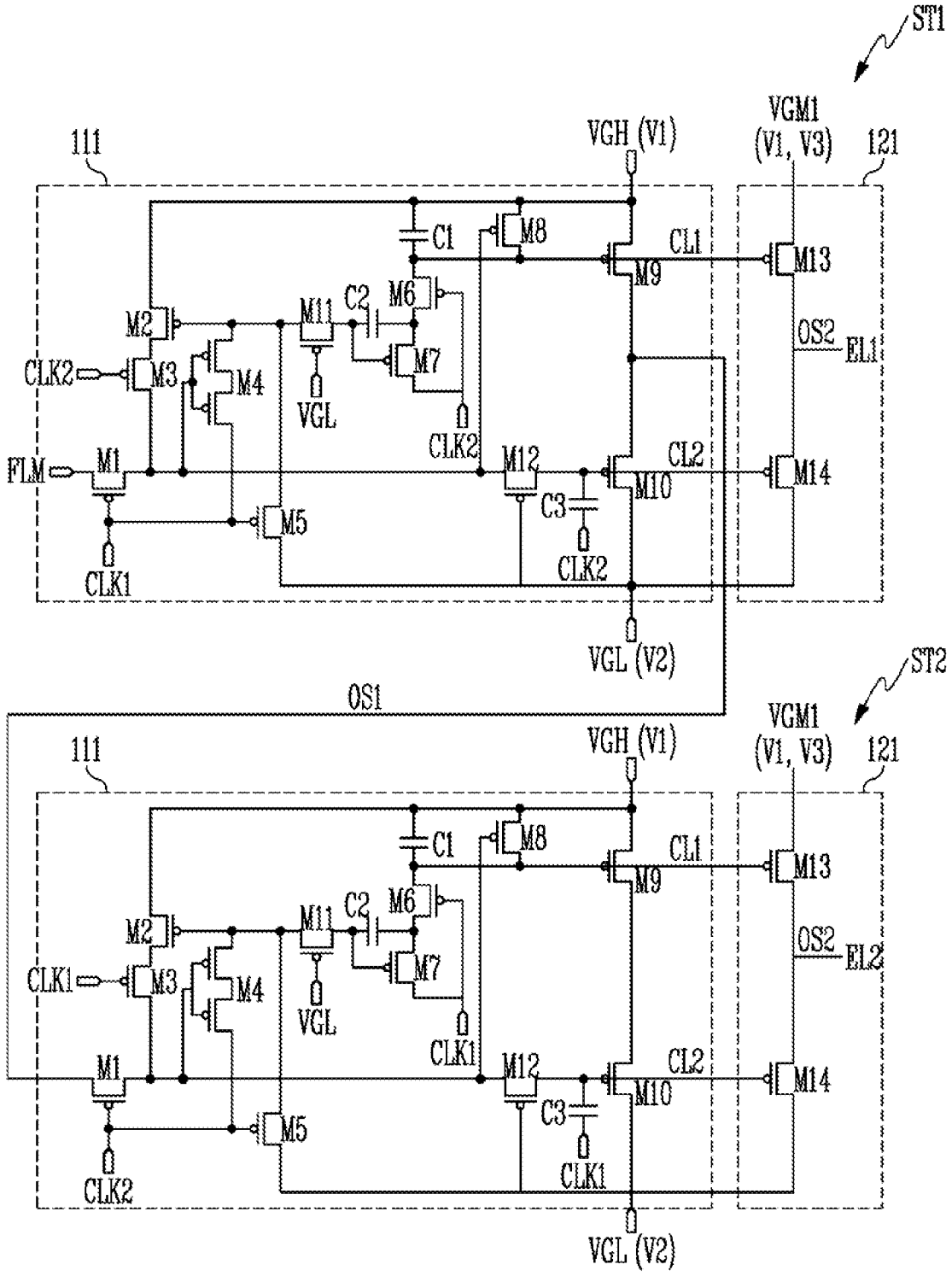
FIG. 7 is an equivalent circuit diagram of the stage circuit of FIG. 6.

FIG. 6 illustrates an emission driver according to an embodiment of the present disclosure. FIG. 7 further illustrates the stage circuit of FIG. 6.

In FIG. 7, a first stage circuit ST1 and a second stage circuit ST2 are illustrated. Because other stage circuits in FIG. 6 can be configured as illustrated in FIG. 7, repeated description will be omitted.

Referring to FIGS. 6 and 7, each of the stage circuits ST1 to STk and STk+1 to STn includes a carry controller 111 and an output buffer 121 or 122.

The carry controller 111 of each of the stage circuits ST1 to STk and STk+1 to STn may start operation by receiving a start signal FLM or the first output signal OS1 of the previous stage circuit. The carry controller 111 of each of the stage circuits ST1 to STk and STk+1 to STn may output the first output signal OS1.

For example, the carry controller 111 included in the first stage circuit ST1 may be supplied with a start signal FLM, and the carry controllers 111 included in the other stage circuits ST2 to STn may be supplied with the first output signal OS1 of the carry controller 111 included in the previous stage circuit.

A first voltage signal VGH and a second voltage signal VGL may be supplied to the carry controller 111 in each of the stage circuits ST1 to STk and STk+1 to STn. The carry controller 111 in each of the stage circuits ST1 to STk and STk+1 to STn may select the first voltage signal VGH or the second voltage signal VGL as the first output signal OS1 based on the first control signal applied to a first control line CL1 and the second control signal applied to a second control line CL2. The first voltage signal VGH may have a first level V1, and the second voltage signal VGL may have a second level V2, which is lower than the first level V1. According to the above-described operation, the carry controllers 111 of sequential rows may sequentially output the first output signals OS1.

Each output buffer 121 or 122 may be coupled to a first intermediate voltage signal line, through which a first intermediate voltage signal VGM1 is supplied, or a second intermediate voltage signal line, through which a second intermediate voltage signal VGM2 is supplied, respectively. The first intermediate voltage signal VGM1 and the second intermediate voltage signal VGM2 may have the first level V1 and a third level V3, which is between the first level V1 and the second level V2. Each output buffer 121 or 122 may select the second voltage signal VGL or the intermediate voltage signal VGM1 or VGM2, generate an emission signal as a second output signal OS2, and output the generated emission signal to a corresponding one of the emission lines EL1 to ELn. When each output buffer 121 or 122 selects the second voltage signal VGL, a voltage level of the emission signal generated as the second output signal OS2 may be the second level V2, and when each output buffer 121 or 122 selects the intermediate voltage signal VGM1 or VGM2, a voltage level of the emission signal generated as the second output signal OS2 may be the first level V1 or the third level V3. Accordingly, each output buffer 121 or 122 can output the second output signal OS2 having the first level V1, the second level V2, or the third level V3.

Each output buffer 121 or 122, respectively, may select the second voltage signal VGL or the intermediate voltage signal VGM1 or VGM2, respectively, as the second output signal OS2 based on the first control signal and the second control signal. The selection may be controlled by the carry controller 111. The output buffer 121 or 122 may be classified as the output buffer 121 coupled to the first intermediate voltage signal line or the output buffer 122 coupled to the second intermediate voltage signal line.

The output buffer 121 or 122 is coupled to the carry controller 111 and control lines CL1 and CL2, and on/off transistors M13 and M14 in the output buffer 121 or 122 may be controlled by the carry controller 111.

Each of the stage circuits ST1 to STk and STk+1 to STn may include a plurality of transistors M1 to M14. Hereinafter, a description will be made on the assumption that the transistors M1 to M14 in each stage circuit are P-type transistors (e.g., PMOS), but those skilled in the art may configure the stage circuit by replacing some or all of the transistors M1 to M14 with N-type transistors (e.g., NMOS) or the like.

Hereinafter, a description will be made based on the first stage circuit ST1. The carry controller 111 may include first to 12th transistors M1 to M12 and first to third capacitors C1 to C3. The output buffer 121 may include 13th and 14th transistors M13 and M14.

The first electrode of the first transistor M1 may be supplied with a start signal FLM, the gate electrode thereof may be supplied with a first clock signal CLK1, and the second electrode thereof may be coupled to the first electrodes of the third transistor M3 and the 12th transistor M12 and the gate electrodes of the fourth transistor M4 and the eighth transistor M8.

The first electrode of the second transistor M2 may be coupled to the second electrode of the third transistor M3, the second electrode thereof may be coupled to the second electrode of the eighth transistor M8 and supplied with a first voltage signal VGH, and the gate electrode thereof may be coupled to the second electrode of the fourth transistor M4 and the first electrode of the 11th transistor M11.

The gate electrode of the third transistor M3 may be supplied with a second clock signal CLK2, the first electrode thereof may be coupled to the second electrode of the first transistor M1, and the second electrode thereof may be coupled to the first electrode of the second transistor M2.

The fourth transistors M4 may take a form in which a plurality of transistors are coupled in series. The first electrode of the transistor on one side, among the fourth transistors M4, may be supplied with the first clock signal CLK1, the second electrode of the transistor on the other side, among the fourth transistors M4, may be coupled to the gate electrode of the second transistor M2, and the gate electrodes of the fourth transistors M4 may be coupled to the second electrode of the first transistor M1.

The first electrode of the fifth transistor M5 may be supplied with a second voltage signal VGL, the second electrode thereof may be coupled to the gate electrode of the second transistor M2 and the first electrode of the 11th transistor M11, and the gate electrode thereof may be supplied with the first clock signal CLK1.

The first electrode of the sixth transistor M6 may be coupled to the second electrode of the seventh transistor M7, the second electrode thereof may be coupled to the gate electrodes of the ninth transistor M9 and the 13th transistor M13, and the gate electrode thereof may be supplied with the second clock signal CLK2.

The first electrode of the seventh transistor M7 may be supplied with the second clock signal CLK2, the second electrode thereof may be coupled to the first electrode of the sixth transistor M6, and the gate electrode thereof may be coupled to the second electrode of the 11th transistor M11.

The first electrode of the eighth transistor M8 may be coupled to the second electrode of the sixth transistor M6, the second electrode thereof may be supplied with the first voltage signal VGH, and the gate electrode thereof may be coupled to the second electrode of the first transistor M1 and the first electrode of the 12th transistor M12.

The first electrode of the ninth transistor M9 may be coupled to a carry output terminal configured to supply the first output signal OS1, the second electrode thereof may be supplied with the first voltage signal VGH, and the gate electrode thereof may be coupled to the second electrode of the sixth transistor M6.

The first electrode of the tenth transistor M10 may be supplied with the second voltage signal VGL, the second electrode thereof may be coupled to the carry output terminal configured to supply the first output signal OS1, and the gate electrode thereof may be coupled to the second electrode of the 12th transistor M12.

The carry output terminal mentioned in the description of the ninth transistor M9 and the tenth transistor M10 may be coupled to the first electrode of the first transistor in the next stage circuit (e.g., the second stage circuit ST2). When the ninth transistor M9 is turned-on by the first control signal and the tenth transistor M10 is turned-off by the second control signal, the carry controller 111 may generate and output the first output signal OS1 of the first level V1 based on the first voltage signal VGH. Also, when the ninth transistor M9 is turned-off by the first control signal and the tenth transistor M10 is turned-on by the second control signal, the carry controller 111 may generate and output the first output signal OS1 of the second level V2 based on the second voltage signal VGL.

The first electrode of the 11th transistor M11 may be coupled to the second electrodes of the fourth transistor M4 and the fifth transistor M5, the second electrode thereof may be coupled to the gate electrode of the seventh transistor M7, and the gate electrode thereof may be supplied with the second voltage signal VGL.

The first electrode of the 12th transistor M12 may be coupled to the second electrode of the first transistor M1, the second electrode thereof may be coupled to the gate electrodes of the tenth transistor M10 and the 14th transistor M14, and the gate electrode thereof may be supplied with the second voltage signal VGL.

The first capacitor C1 may electrically couple a node that is supplied with the first voltage signal VGH to the second electrode of the sixth transistor, the gate electrode of the ninth transistor M9, and the gate electrode of the 13th transistor M13.

The second capacitor C2 may electrically couple the gate electrode of the seventh transistor M7 and the second electrode of the 11th transistor M11 to the first electrode of the sixth transistor M6 and the second electrode of the seventh transistor M7.

The third capacitor C3 may electrically couple the second clock signal CLK2 to the second electrode of the 12th transistor M12, the gate electrode of the tenth transistor M10, and the gate electrode of the 14th transistor M14.

The first electrode of the 13th transistor M13 may be coupled to an emission line, the second electrode thereof may be supplied with a first intermediate voltage signal VGM1, and the gate electrode thereof may be coupled to the second electrode of the sixth transistor M6. The gate electrode of the 13th transistor M13 may be coupled to the first control line extended from the carry controller 111. The first control line may be electrically coupled to the same node to which the second electrode of the sixth transistor M6 is coupled.

The first electrode of the 14th transistor M14 may be supplied with the second voltage signal VGL, the second electrode thereof may be coupled to the emission line, and the gate electrode thereof may be coupled to the second electrode of the 12th transistor M12. The gate electrode of the 14th transistor M14 may be coupled to the second control line extended from the carry controller 111. The second control line may be electrically coupled to the same node to which the second electrode of the 12th transistor M12 is coupled.

When the 13th transistor M13 is turned-off by the first control signal and the 14th transistor M14 is turned-on by the second control signal, the output buffer 121 may generate and output the second output signal OS2 of the second level V2 as the emission signal based on the second voltage signal VGL. Also, when the 13th transistor M13 is turned-on by the first control signal and the 14th transistor M14 is turned-off by the second control signal, the output buffer 121 may generate and output the second output signal OS2 of the first level V1 or the third level V3 as the emission signal based on the first intermediate voltage signal VGM1.

The second electrode of the 13th transistor M13 of each of the (k+1)-th to n-th stage circuits STk+1 to STn may be supplied with a second intermediate voltage signal VGM2 instead of the first intermediate voltage signal VGM1, but is otherwise similar to that described above.

The second stage circuit ST2 may be configured such that the terminal, corresponding to the terminal supplied with the first clock signal CLK1 in the first stage circuit ST1, is supplied with the second clock signal CLK2, and such that the terminal, corresponding to the terminal supplied with the second clock signal CLK2 in the first stage circuit ST1, is supplied with the first clock signal CLK1.

That is, the terminal controlled by the first clock signal CLK1 in the odd-numbered stage circuits ST1, ST3, . . . , may be controlled by the second clock signal CLK2 in the even-numbered stage circuits ST2, ST4, . . . , and the terminal controlled by the second clock signal CLK2 in the odd-numbered stage circuits ST1, ST3, . . . , may be controlled by the first clock signal CLK1 in the even-numbered stage circuits ST2, ST4, . . . .

The first clock signal CLK1 and the second clock signal CLK2 may have the same frequency. That is, the first clock signal CLK1 and the second clock signal CLK2 have the same period. The second clock signal CLK2 is a signal shifted from the first clock signal CLK1 by half the period of the first clock signal CLK1, or 180 degrees of phase.

The start signal FLM may be supplied only to the first stage circuit ST1. The start signal FLM may be changed from a low level to a high level when the first clock signal CLK1 changes from a high level to a low level. The start signal FLM maintains a high level during some periods after it changes from a low level to the high level. That is, the start signal FLM is activated when the first clock signal CLK1 changes from a high level to a low level, and the activated state is maintained during some periods.

Hereinafter, the high level of each signal is defined as the first level V1, and the low level, which is lower than the high level, is defined as the second level V2. Also, the second voltage signal VGL may have the second level V2, and the first voltage signal VGH may have the first level V1. Here, the first intermediate voltage signal VGM1 and the second intermediate voltage signal VGM2 may each have a voltage level between the voltage level of the second voltage signal VGL and that of the first voltage signal VGH. In an embodiment, the first intermediate voltage signal VGM1 and the second intermediate voltage signal VGM2 may each have the first level V1 or the third level V3 between the first level V1 and the second level V2. For example, the first intermediate voltage signal VGM1 and the second intermediate voltage signal VGM2 may each have the first level V1 in a first period (e.g., a data programming period) of one frame period and may each have the third level V3 in a second period (e.g., a holding period) of one frame period. Here, in the case that each output buffer 121 or 122 generates the second output signal OS2 corresponding to a voltage level of the intermediate voltage signal VGM1 or VGM2, each output buffer 121 or 122 may output the second output signal OS2 of the first level V1 as the emission signal to a corresponding one of the emission lines EL1 to ELn in the first period of one frame period, and may output the second output signal OS2 of the third level V3 as the emission signal to a corresponding one of the emission lines EL1 to ELn in the second period of one frame period.

In an embodiment, the first level V1 may range from about 14.5 V to about 15.5 V, the second level V2 may range from about 1.5 V to about 2.5 V, and the third level V3 may range from about 7.5 V to about 8.5 V. However, embodiments are not limited to the above-described voltage level ranges.

In an embodiment, the voltage level of the first intermediate voltage signal VGM1 may be the same as that of the second intermediate voltage signal VGM2, but the voltage levels are not limited thereto.

The carry controller 111 of each of the stage circuits ST1 to STk and STk+1 to STn may control the transistors M13 and M14 of the output buffer 121 or 122, thereby selectively outputting the second voltage signal VGL or the intermediate voltage signal VGM1 or VGM2 as the second output signal OS2. The output buffer 121 or 122 may be supplied with the first control signal from the carry controller 111 through the first control line CL1 and supplied with the second control signal through the second control line CL2. For example, each of the stage circuits ST1 to STk and STk+1 to STn turns off the 13th transistor M13 and turns on the 14th transistor M14, thereby outputting a signal, corresponding to the voltage level of the second voltage signal VGL, to a corresponding one of the emission lines EL1 to ELn as the second output signal OS2. Also, each of the stage circuits ST1 to STk and STk+1 to STn turns on the 13th transistor M13 and turns off the 14th transistor M14, thereby outputting a signal, corresponding to the voltage level of the first intermediate voltage signal VGM1 or the second intermediate voltage signal VGM2, to a corresponding one of the emission lines EL1 to ELn as the second output signal OS2.

Figure 8:
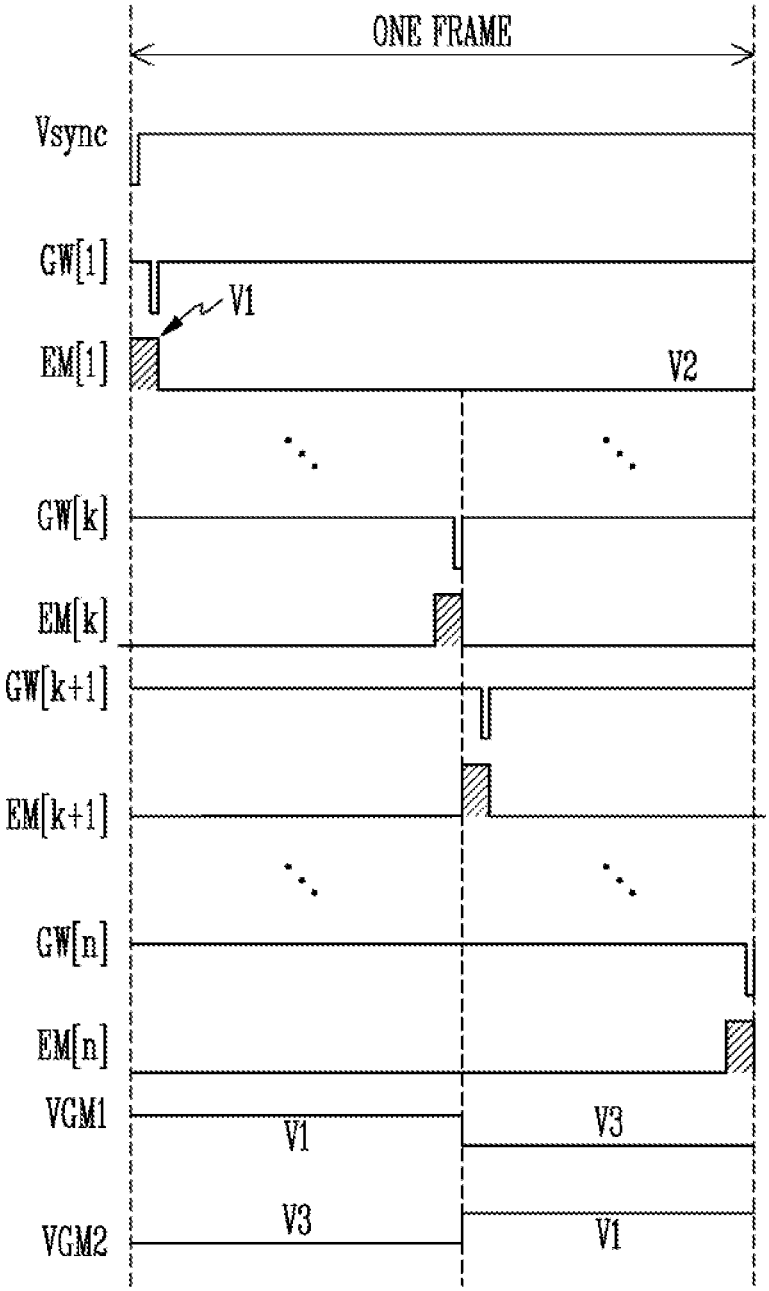
FIGS. 8 and 9 are timing diagrams illustrating a method of driving a display device according to an embodiment of the present disclosure.
Figure 9:
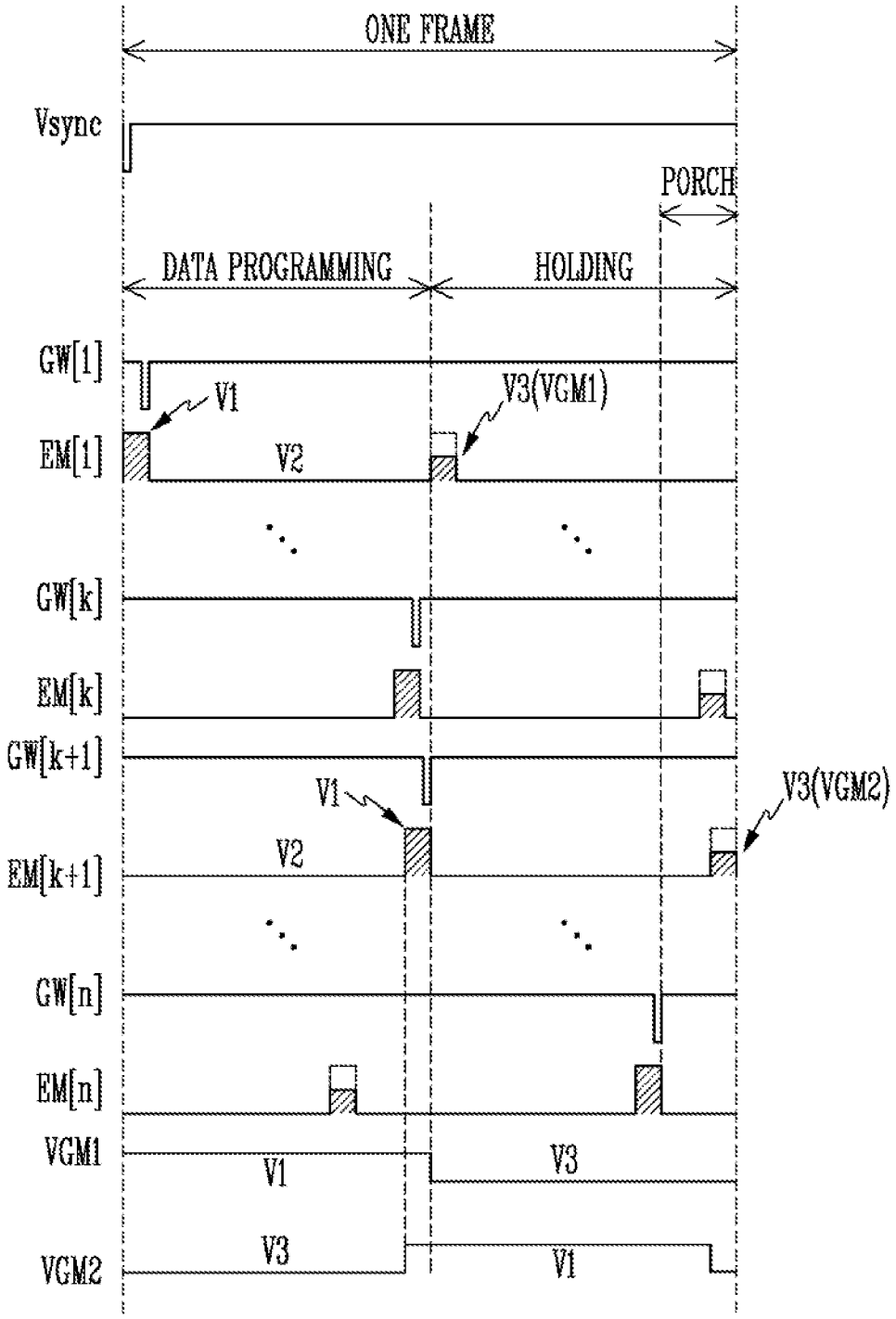

FIGS. 8 and 9 illustrate a method of driving a display device according to an embodiment of the present disclosure. FIG. 8 illustrates the case in which the display device 1 is driven at a first frequency, which is a relatively high frequency, and FIG. 9 illustrates the case in which the display device 1 is driven at a second frequency, which is a relatively low frequency.

For example, the first frequency may be the highest frequency in the range of a frequency at which the display device 1 can be driven.

Referring to FIG. 8, when the emission signals EM[1] to EM[n] have a high level (e.g., 14.5 V to 15.5 V) in the pixel rows PXL1 to PXLn, the fifth transistor M5 and the sixth transistor M6 of each pixel may maintain a turned-off state, and when the emission signals EM[1] to EM[n] have a low level (e.g., 1.5 V to 2.5 V), the fifth transistor M5 and the sixth transistor M6 may maintain a turned-on state. Accordingly, when the emission signals EM[1] to EM[n] have a high level in the pixel rows PXL1 to PXLn, the period may be defined as a non-emission period, and when the emission signals EM[1] to EM[n] have a low level, the period may be defined as an emission period.

In an embodiment, when the display device 1 is driven at the first frequency, a frame period may include only a data programming period. The data programming period may be configured such that the threshold voltage signal of the driving transistor is compensated for, the anode is initialized, and data signal is written during the non-emission period and such that the light-emitting diode LD may emit light during the emission period. For example, in the non-emission period, a scan signal GW[1] to GW[n] having a low level, which is able to turn on the second transistor T2, may be supplied to the pixel.

In an operation of the embodiment as shown in FIG. 8, when the display device 1 is driven at the first frequency, the emission driver 40 may be controlled so as to output emission signals EM[1] to EM[n] of only the first and second levels V1 and V2. For example, the emission driver 40 may output the emission signals EM[1] to EM[n] of the first level V1 of the second level V2 during one frame period. Here, no holding period is needed.

In an operation of the embodiment as shown in FIG. 9, when the display device 1 is driven at the second frequency, a frame period may include a data programming period and a holding period. Also, at least a portion of a frame period may include a porch period. For example, for each of the pixel rows PXL1 to PXLn, the porch period may be included in the holding period. The period from the time at which the non-emission period within the data programing period of the n-th pixel row PXLn finishes to the time at which the non-emission period of the first pixel row PXL1 starts may be defined as a porch period. The porch period is a period in which the pixels arranged in parallel in a horizontal direction are synchronized because a horizontal synchronization signal is turned on when driven at the second frequency.

In an embodiment, the data programming period of each of the pixel rows PXL1 to PXLn may include a period for compensating for the threshold voltage signal of the driving transistor, a period for initializing the anode, and a period for writing a data signal in the non-emission period and may include a period in which the light-emitting diode LD emits light in the emission period.

In an embodiment, the holding period of each of the pixel rows PXL1 to PXLn may include a period in which the driving transistor is set to an on-biased state. In the period in which the driving transistor is set to an on-biased state, the first to k-th stage circuits ST1 to STk may output the emission signals EM[1] to EM[n] of the third level V3 to the emission lines. Similarly, the (k+1)-th to n-th stage circuits STk+1 to STn may output the emission signals EM[1] to EM[n] of the third level V3 to the emission lines.

When the emission signal of the third level V3 is supplied to the gate electrodes of the fifth transistor T5 and the sixth transistor T6 of each pixel, the sixth transistor T6 may maintain a turned-off state and the fifth transistor T5 may maintain a turned-on state.

While the sixth transistor T6 maintains the turned-off state and the fifth transistor T5 maintains the turned-on state, the high-supply voltage signal ELVDD may be supplied to the first electrode of the first transistor T1. Accordingly, the first transistor T1 may be set to an on-biased state.

In an embodiment, the holding period may include an emission period after the period in which the driving transistor is set to an on-biased state. Each of the stage circuits ST1 to STk and STk+1 to STn may output an emission signal of the second level V2 to the emission line after the period in which the driving transistor is set to the on-biased state. When the emission signal of the second level V2 is supplied to the gate electrodes of the fifth transistor T5 and the sixth transistor T6 of each pixel, the fifth transistor T5 and the sixth transistor T6 may maintain the turned-on state, and the light-emitting diode LD may emit light.

As described above, the present embodiment may enable the driving transistor to be set to an on-biased state by turning on the first emission transistor T5 and turning off the second emission transistor T6 in a pixel by supplying an emission signal of the third level V3 to a single emission line.

Next, a display device according to another embodiment will be described. Hereinafter, a description of the same components in FIGS. 1 to 9 will be omitted, and the same or similar reference numerals will be used therefor.

Figure 10:
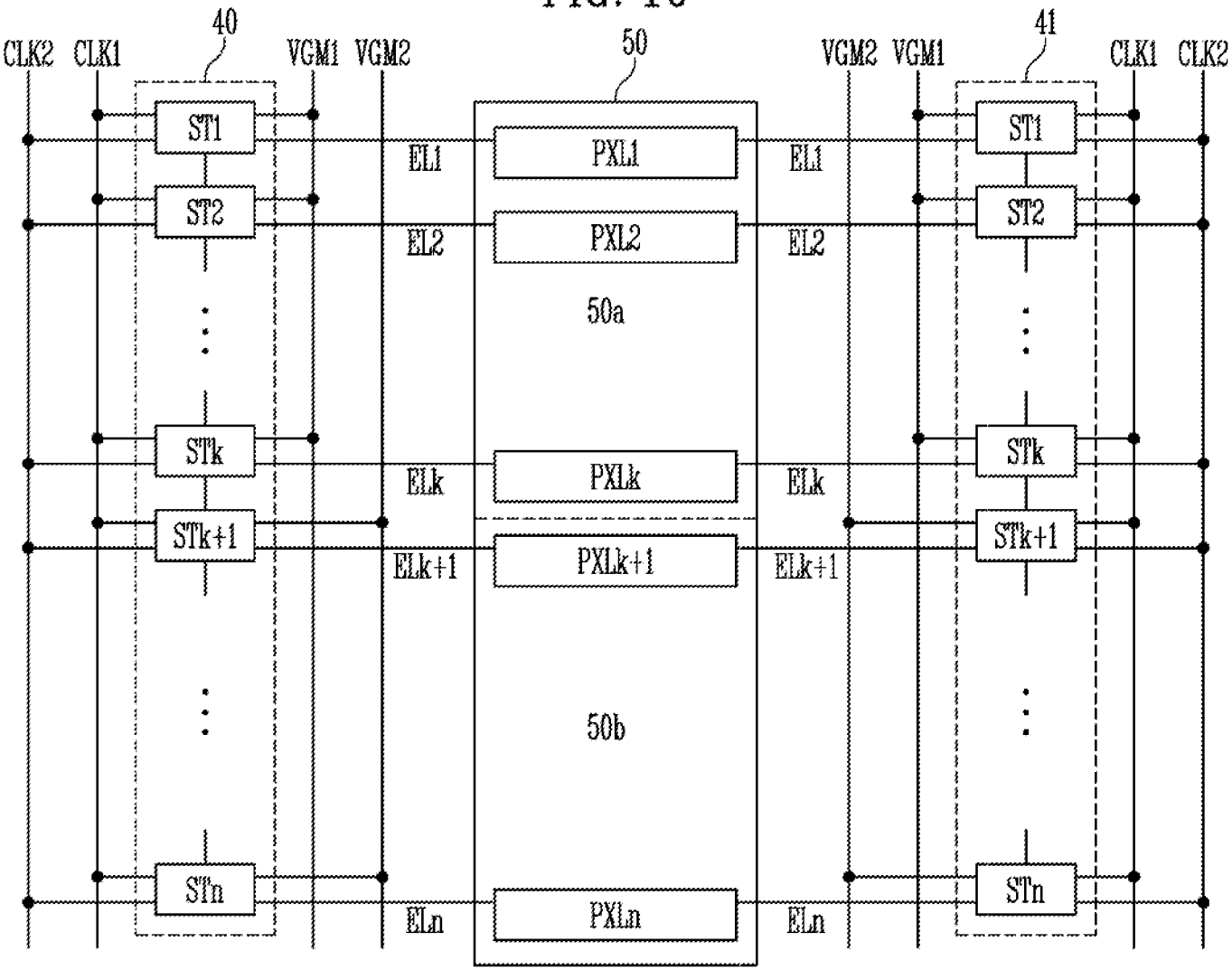
FIG. 10 is a block diagram illustrating the relationship between an emission driver and a display in a display device according to another embodiment of the present disclosure.

FIG. 10 illustrates the relationship between an emission driver and a display in a display device according to yet another embodiment of the present disclosure. Referring to FIG. 10, the present embodiment is different from the embodiment of FIG. 5 in that a plurality of emission drivers 40 and 41 are present.

In an embodiment, a first emission driver 40 may be disposed on one side of the display 50 and a second emission driver 41 may be disposed on the other side thereof. Each of the first emission driver 40 and the second emission driver 41 may include first to n-th stage circuits ST1 to STk and STk+1 to STn. Each of the stage circuits ST1 to STk and STk+1 to STn in the first emission driver 40 and the stage circuit corresponding thereto in the second emission driver 41 may supply the same emission signal to the same pixel row, among pixel rows PXL1 to PXLn. That is, each of the emission lines EL1 to ELn coupled to corresponding ones of the stage circuits ST1 to STk and STk+1 to STn in the first emission driver 40 and the second emission driver 41 may be coupled to the same pixel row, among pixel rows PXL1 to PXLn, and the emission lines coupled to the same pixel row may be electrically coupled to each other.

Each of the first emission driver 40 and the second emission driver 41 performs the same function as the emission driver 40 of FIG. 5, and thus a repeated description will be omitted. The first emission driver 40 and the second emission driver 41 are provided on one side and the other side of the display 50, whereby the emission signal may be supplied to the pixels in each of the pixel rows PXL1 to PXLn at the same time.

Figure 11:
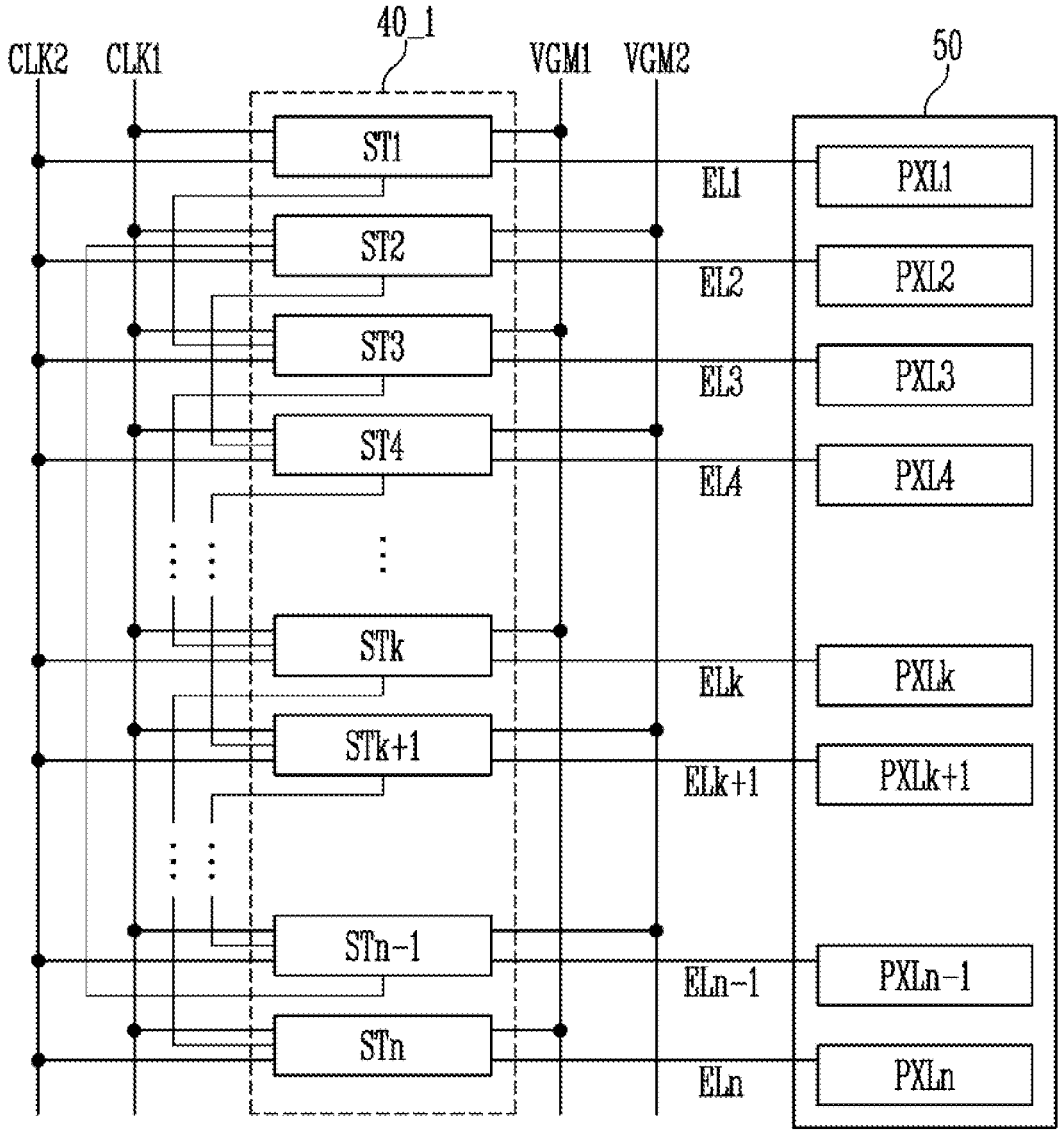
FIG. 11 is a block diagram illustrating the relationship between an emission driver and a display in a display device according to yet another embodiment of the present disclosure.

FIG. 11 illustrates the relationship between an emission driver and a display in a display device according to yet another embodiment of the present disclosure. Referring to FIG. 11, the present embodiment is different from the embodiment of FIG. 5 in that the stage circuits ST1 to STk and STk+1 to STn, in an emission driver 40_1, are coupled in an interlace manner. In the present embodiment, a description will be made on the assumption that n is an even number, but embodiments are not limited thereto.

In an embodiment, the first output signal of the first stage circuit ST1 may be supplied to the third stage circuit ST3. Also, although not clearly illustrated, the first output signal of the third stage circuit ST3 may be supplied to the fifth stage circuit ST5. In this way, the first output signal is transmitted to the odd-numbered stage circuits, whereby the first output signal may finally reach the (n−1)-th stage circuit STn−1, which is the last odd-numbered circuit.

Then, the first output signal of the (n−1)-th stage circuit STn−1 may be supplied to the second stage circuit ST2. The first output signal of the second stage circuit ST2 may be supplied to the fourth stage circuit ST4. In this way, the first output signal is transmitted to the even-numbered circuits, and the first output signal may finally reach the n-th stage circuit STn, which is the last even-numbered circuit.

Because the emission driver 40_1 operates in an interlace manner, electric coupling between adjacent pixel rows PXL1 to PXLn may be reduced, whereby power consumed by a display device may be reduced.

Figure 12:
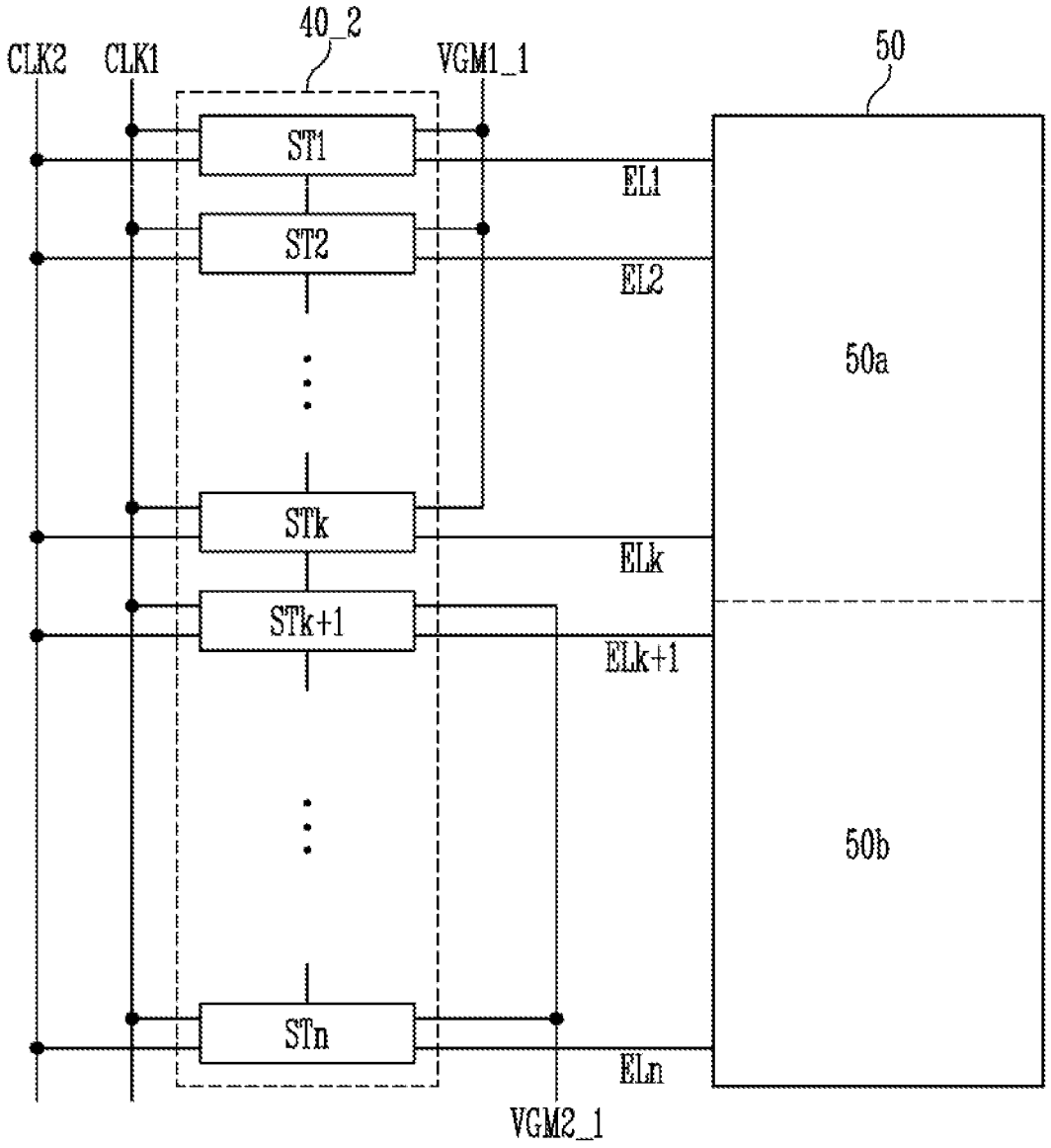
FIG. 12 is a block diagram illustrating the relationship between an emission driver and a display in a display device according to yet another embodiment of the present disclosure.

FIG. 12 illustrates the relationship between an emission driver and a display in a display device according yet another embodiment of the present disclosure. Referring to FIG. 12, the present embodiment is different from the embodiment of FIG. 5 in that the first intermediate voltage signal line and the second intermediate voltage signal line coupled to the emission driver 40_2 do not cross over each other.

In an embodiment, the first intermediate voltage signal line through which the first intermediate voltage signal VGM1_1 is supplied is extended from one side of the display device, thereby being coupled to the first to k-th stage circuits ST1 to STk. The second intermediate voltage signal line through which the second intermediate voltage signal VGM2_1 is supplied is extended from the other side of the display device, thereby being coupled to the (k+1)-th to n-th stage circuits STk+1 to STn. That is, the direction in which the first intermediate voltage signal line extends and the direction in which the second intermediate voltage signal middle line extends may be opposite to each other.

Figure 13:
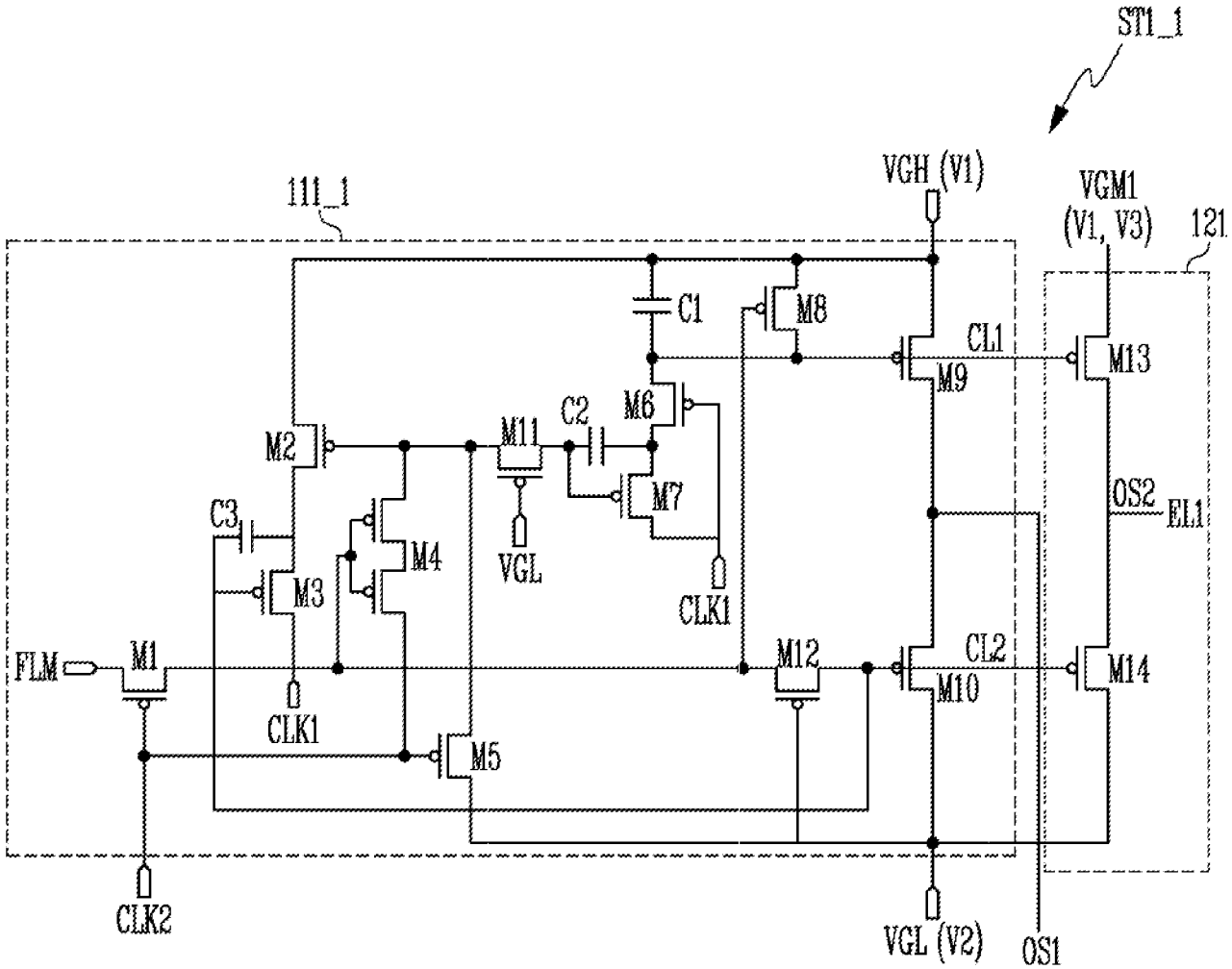
FIG. 13 is an equivalent circuit diagram of a stage circuit in an emission driver according to yet another embodiment of the present disclosure.

FIG. 13 illustrates a stage circuit in an emission driver according to yet another embodiment of the present disclosure. Referring to FIG. 13, the first stage circuit ST1_1 according to the present embodiment is different from the embodiment of FIG. 7 in that the equivalent circuit of the carry controller 111_1 is different.

The first electrode of the first transistor M1 may be supplied with a start signal FLM, the gate electrode thereof may be supplied with a second clock signal CLK2, and the second electrode thereof may be coupled to the first electrode of the 12th transistor M12 and the gate electrodes of the fourth transistor M4, the eighth transistor M8, and the tenth transistor M10.

The first electrode of the second transistor M2 may be coupled to the second electrode of the third transistor M3, the second electrode thereof may be coupled to the second electrode of the eighth transistor M8 and supplied with a first voltage signal VGH, and the gate electrode thereof may be coupled to the second electrode of the fourth transistor M4 and the first electrode of the 11th transistor M11.

The gate electrode of the third transistor M3 may be coupled to the second electrode of the 12th transistor M12, the first electrode thereof may be supplied with a first clock signal CLK1, and the second electrode thereof may be coupled to the first electrode of the second transistor M2.

The fourth transistors M4 may take a form in which a plurality of transistors are coupled in series. The first electrode of the transistor on one side, among the fourth transistors M4, may be supplied with the second clock signal CLK2, the second electrode of the transistor on the other side, among the fourth transistors M4, may be coupled to the gate electrode of the second transistor M2, and the gate electrodes of the fourth transistors M4 may be coupled to the second electrode of the first transistor M1.

The first electrode of the fifth transistor M5 may be supplied with the second voltage signal VGL, the second electrode thereof may be coupled to the gate electrode of the second transistor M2 and the first electrode of the 11th transistor M11, and the gate electrode thereof may be supplied with the second clock signal CLK2.

The first electrode of the sixth transistor M6 may be coupled to the second electrode of the seventh transistor M7, the second electrode thereof may be coupled to the gate electrodes of the ninth transistor M9 and the 13th transistor M13 and the first electrode of the eighth transistor M8, and the gate electrode thereof may be supplied with the first clock signal CLK1.

The first electrode of the seventh transistor M7 may be supplied with the first clock signal CLK1, the second electrode thereof may be coupled to the first electrode of the sixth transistor M6, and the gate electrode thereof may be coupled to the second electrode of the 11th transistor M11.

The first electrode of the eighth transistor M8 may be coupled to the second electrode of the sixth transistor M6 and the gate electrodes of the ninth transistor M9 and the 13th transistor M13, the second electrode thereof may be supplied with the first voltage signal VGH, and the gate electrode thereof may be coupled to the second electrode of the first transistor M1 and the first electrode of the 12th transistor M12.

The first electrode of the ninth transistor M9 may be coupled to a carry output terminal configured to supply a first output signal OS1, the second electrode thereof may be supplied with the first voltage signal VGH, and the gate electrode thereof may be coupled to the second electrode of the sixth transistor M6 and the first electrode of the eighth transistor.

The first electrode of the tenth transistor M10 may be supplied with the second voltage signal VGL, the second electrode thereof may be coupled to the carry output terminal configured to supply the first output signal OS1, and the gate electrode thereof may be coupled to the second electrode of the 12th transistor M12.

The carry output terminal mentioned in the description of the ninth transistor M9 and the tenth transistor M10 may be coupled to the first electrode of the first transistor in the next stage circuit (e.g., the second stage circuit ST2).

The first electrode of the 11th transistor M11 may be coupled to the second electrodes of the fourth transistor M4 and the fifth transistor M5, the second electrode thereof may be coupled to the gate electrode of the seventh transistor M7, and the gate electrode thereof may be supplied with the second voltage signal VGL.

The first electrode of the 12th transistor M12 may be coupled to the second electrode of the first transistor M1, the second electrode thereof may be coupled to the gate electrodes of the tenth transistor M10 and the 14th transistor M14, and the gate electrode thereof may be supplied with the second voltage signal VGL.

The first capacitor C1 may electrically couple a node that is supplied with the first voltage signal VGH to the second electrode of the sixth transistor, the gate electrode of the ninth transistor M9, and the gate electrode of the 13th transistor M13.

The second capacitor C2 may electrically couple the gate electrode of the seventh transistor M7 and the second electrode of the 11th transistor M11 to the first electrode of the sixth transistor M6 and the second electrode of the seventh transistor M7.

The third capacitor C3 may electrically couple the second electrode of the third transistor M3 and the first electrode of the second transistor M2 to the gate electrodes of the tenth transistor M10 and the 14th transistor M14.

However, the circuit of the carry controller 111_1 is not limited to this example, and various known circuits may be applied.

Figure 14:
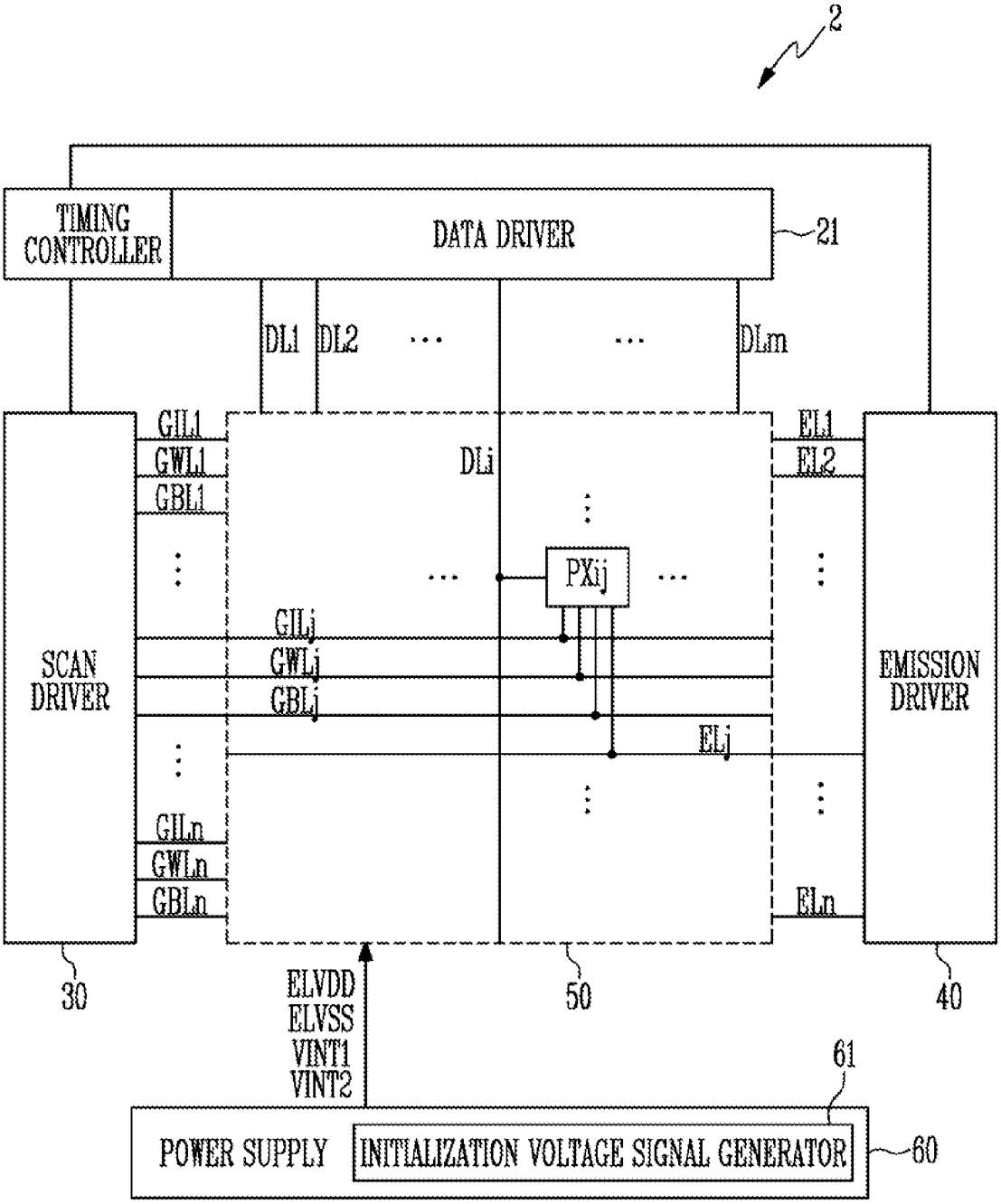
FIG. 14 is a block diagram schematically illustrating a display device according to yet another embodiment of the present disclosure.

FIG. 14 illustrates a display device according to yet another embodiment of the present disclosure. Referring to FIG. 14, the data driver 21 according to the present embodiment is different from the embodiment of FIG. 2 in that a timing controller is included in the data driver 21.

The data driver 20 and the timing controller 10 described in the embodiment of FIG. 2 may be integrated. In an embodiment, the data driver 21 may include the timing controller. For example, the data driver 21 may be provided in the form of timing controller-embedded driver integrated circuits (TEDs).

The TEDs may take a form in which the timing controller 10, the data driver 20, the scan driver 30, and the emission driver 40 of FIG. 2 are integrated.

According to embodiments of the present disclosure, although pixels in a display device are coupled to a single emission line, a driver transistor may be set to an on-biased state using a supply voltage.

Also, although a display device is driven at a plurality of frequencies, visibility of an afterimage may be minimized.

Effects obtainable from embodiments are not limited by the above-mentioned effects, and various effects are included in this description.

While exemplary embodiments of the present disclosure have been described in detail with reference to the drawings, it will be understood by those of ordinary skill in the pertinent art that the present disclosure can be implemented in other specific forms without changing the technical scope or spirit of the present disclosure. Therefore, it should be noted that the forgoing embodiments are merely illustrative in all aspects and are not to be construed as limiting the present disclosure.

What is claimed is:

1. A display device, comprising:

a plurality of pixels including first to k-th pixel rows and (k+1)-th to n-th pixel rows, wherein each pixel of the plurality of pixels includes:

a driving transistor including a first electrode, a second electrode, and a first gate electrode;

a first emission transistor including a third electrode coupled to the first electrode of the driving transistor, a fourth electrode, and a second gate electrode; and a second emission transistor including a fifth electrode coupled to the second electrode of the driving transistor, a sixth electrode, and a third gate electrode, wherein both the second gate electrode and the third gate electrode are coupled to an emission line, wherein the first emission transistor is turned-on but the second emission transistor is turned-off, based on an emission signal having a first level, a second level, or a third level between the first level and the second level, supplied from the emission line, wherein the emission signal of the third level is supplied to at least some of the first to k-th pixel rows within a period in which the emission signal of the first level is supplied to at least some of the (k+1)-th to n-th pixel rows.

2. The display device according to claim 1, wherein the driving transistor, the first emission transistor, and the second emission transistor are P-type metal-oxide-semiconductor (PMOS) transistors.

3. The display device according to claim 1, wherein a threshold voltage of the second emission transistor is greater than a threshold voltage of the first emission transistor.

4. The display device according to claim 1, wherein a frame period includes a data programming period in which a data signal is written and each of the pixels emits light, and a holding period in which the emission signal of the third level is supplied to each of the pixels and each of the pixels emits light.

5. The display device according to claim 1, wherein each pixel of the plurality of pixels further includes a light-emitting diode, and wherein the sixth electrode is coupled to an anode of the light-emitting diode.

6. The display device according to claim 5, wherein:

the fourth electrode is coupled to a first power line through which a first power voltage signal is supplied, and a cathode of the light-emitting diode is coupled to a second power line through which a second power voltage signal having a lower level than the first power voltage signal.

7. The display device according to claim 1, further comprising:

an emission driver which supplies the emission signal to both the second gate electrode and the third gate electrode through the emission line.

8. The display device according to claim 7, wherein the emission driver supplies to the pixel the emission signal through the emission line.

9. The display device according to claim 8, wherein, when the emission signal of the third level is supplied to the pixel, the first emission transistor is turned-on but the second emission transistor is turned-off.

10. The display device according to claim 8, wherein:

when the emission signal of the first level is supplied to the pixel, the first emission transistor and the second emission transistor are turned-off, and when the emission signal of the second level is supplied to the pixel, the first emission transistor and the second emission transistor are turned-on.

11. The display device according to claim 8, wherein, when the emission signal of the third level is supplied to the pixel, the driving transistor is set to an on-biased state.

12. The display device according to claim 8, wherein a voltage range of the third level is from about 7.5 V to about 8.5 V.

13. An emission driver, comprising:

a plurality of stage circuits, each of the stage circuits including:

a carry controller which generates a first output signal having a first level or a second level based on a first control signal and a second control signal; and an output buffer which is coupled to a first control line and a second control line, and generates a second output signal having one of the first level, the second level, and a third level between the first level and the second level based on the first control signal supplied from the first control line and the second control signal supplied from the second control line, wherein a plurality of pixel rows includes first to k-th pixel rows and (k+1)-th to n-th pixel rows and the second output signal of the third level is supplied to at least some of the first to k-th pixel rows within a period in which the second output signal of the first level is supplied to at least some of the (k+1)-th to n-th pixel rows.

14. The emission driver according to claim 13, wherein the output buffer is coupled to an intermediate voltage signal line through which one of a voltage signal of the first level and a voltage signal of the third level is supplied.

15. The emission driver according to claim 14, wherein:

in a first period of a frame period, the output buffer generates the second output signal having the first level based on the first control signal, and in a second period of the frame period, the output buffer generates the second output signal having the third level based on the first control signal.

16. The emission driver according to claim 15, wherein the stage circuits comprise a first stage circuit and a second stage circuit, wherein the second stage circuit is connected to the first stage circuit, and wherein the first output signal of the first stage circuit is supplied to the carry controller of the second stage circuit.

17. A display device, comprising:

a display including a plurality of pixel rows, each of which is defined by a plurality of pixels coupled to a same emission line;

a scan driver configured to supply a scan signal to each of the pixels;

a data driver configured to supply a data signal to each of the pixels; and an emission driver configured to supply an emission signal to each of the pixel rows through the emission line, wherein the emission signal has a first level, a second level, or a third level between the first level and the second level, wherein the plurality of pixel rows includes first to k-th pixel rows and (k+1)-th to n-th pixel rows, wherein the first to k-th pixel rows are coupled to a first intermediate voltage line through which a voltage of the third level is supplied, and wherein the (k+1)-th to n-th pixel rows are coupled to a second intermediate voltage line through which a voltage of the third level is supplied, k and n being natural numbers and k being greater than 1 and less than n.

18. The display device according to claim 17, wherein the emission driver comprises a pair of emission drivers disposed on opposite sides of the display, respectively.

19. The display device according to claim 17, wherein the first level is higher than the second level.

20. The display device according to claim 17, wherein the emission signal of the third level is supplied to at least some of the first to k-th pixel rows within a period in which the emission signal of the first level is supplied to at least some of the (k+1)-th to n-th pixel rows.

21. The display device according to claim 20, wherein the first intermediate voltage line and the second intermediate voltage line are insulated from each other and cross over each other.

22. The display device according to claim 20, wherein k is substantially half of n.

23. A display device, comprising:

a display including a plurality of pixel rows, each of which is defined by a plurality of pixels coupled to a same emission line;

a scan driver configured to supply a scan signal to each of the pixels;

a data driver configured to supply a data signal to each of the pixels; and an emission driver configured to supply an emission signal to each of the pixel rows through the emission line, wherein the emission signal has a first level, a second level, or a third level between the first level and the second level, wherein a frame period includes:

a data programming period in which the data signal is written and each of the pixels emits light; and a holding period in which the emission signal of the third level is supplied to each of the pixels and each of the pixels emits light.

24. The display device according to claim 23, wherein each of the pixels is driven at a first frequency and a second frequency, which is lower than the first frequency.

25. The display device according to claim 24, wherein, when driven at the second frequency, the frame period further includes a porch period in which respective pixels arranged in parallel in a horizontal direction are synchronized.

* * * * *